US010273700B2

(12) United States Patent
Anderson et al.

(10) Patent No.: US 10,273,700 B2
(45) Date of Patent: Apr. 30, 2019

(54) FLOOR STRIPPING MACHINE, BLADE ASSEMBLY FOR USE THEREWITH, AND METHODS

(71) Applicant: Anderson Innovations, LLC, Two Harbors, MN (US)

(72) Inventors: Martin L. Anderson, Two Harbors, MN (US); Quinn M. Anderson, Ephrata, WA (US); Joseph M. Anderson, Duluth, MN (US)

(73) Assignee: Anderson Innovations, LLC, Two Harbors, MN (US)

( * ) Notice: Subject to any disclaimer, the term of this patent is extended or adjusted under 35 U.S.C. 154(b) by 0 days.

(21) Appl. No.: 15/629,092

(22) Filed: Jun. 21, 2017

(65) Prior Publication Data

US 2018/0371770 A1 Dec. 27, 2018

(51) Int. Cl.
*E04G 23/00* (2006.01)

(52) U.S. Cl.
CPC ..... *E04G 23/006* (2013.01)

(58) Field of Classification Search
CPC ..... E04G 23/006
See application file for complete search history.

(56) References Cited

U.S. PATENT DOCUMENTS 2,245,544 A * 6/1941 Miller ..... E04G 23/006 15/93.1
2,465,192 A * 3/1949 Booth ..... E04G 23/006 15/93.1
4,668,017 A 5/1987 Peterson et al.
4,683,657 A 8/1987 Anderson et al.
5,037,160 A * 8/1991 Ukai ..... E04G 23/006 173/24
5,082,330 A 1/1992 Holder
5,702,161 A 12/1997 Finney et al.
5,772,284 A * 6/1998 Lindsey ..... E04G 23/006 15/93.1
5,830,313 A * 11/1998 Smith ..... E04G 23/006 156/763
5,992,791 A 11/1999 Tsuda et al.
6,092,876 A 7/2000 Arbucci
6,135,566 A 10/2000 Anderson
6,230,410 B1 5/2001 Taylor et al.
6,264,282 B1 7/2001 Gaumont
6,273,513 B1 8/2001 Pope
6,299,257 B1 * 10/2001 Constantino ..... E04G 23/006 15/93.1

(Continued)

FOREIGN PATENT DOCUMENTS

JP 2017095906 A 6/2017

OTHER PUBLICATIONS

National; "Flooring Tools & Equipment", Catalog 2004, 4 pages.

(Continued)

*Primary Examiner* — Janine M Kreck
(74) *Attorney, Agent, or Firm* — Merchant & Gould P.C.

(57) ABSTRACT

A floor stripping machine for removing floor covering from a floor surface includes a base, a motor secured to the base, a rear wheel arrangement driven by the motor, and a blade assembly. The blade assembly is secured to a remaining portion of the machine and has a removable clamp with a cutter. The machine has a forward downward sloping angle, a low center of gravity, and is obstruction free for mounting by an operator. The blade assembly may include a dovetail for a variety of tool heads. One example of a blade has a base flange, a pair of side flanges with forward leaning angles, and a hook in between each side flange and the base flange.

14 Claims, 24 Drawing Sheets

(56) References Cited

U.S. PATENT DOCUMENTS

| | | | | |
|---|---|---|---|---|
| 6,343,981 | B1 | 2/2002 | Buchanan | |
| 6,540,305 | B2 | 4/2003 | Phillips | |
| 6,609,762 | B2 | 8/2003 | Anderson | |
| 6,813,834 | B2 | 11/2004 | Anderson | |
| 7,082,686 | B2 | 8/2006 | Anderson | |
| 7,228,808 | B1 | 6/2007 | Anderson | |
| 7,562,412 | B1 | 7/2009 | Anderson | |
| 7,563,153 | B2 | 7/2009 | Haddadi | |
| 7,563,156 | B2 | 7/2009 | Anderson | |
| 2002/0109394 | A1* | 8/2002 | Phillips | E04G 23/006 299/36.1 |
| 2003/0040265 | A1 | 2/2003 | Palushi | |
| 2010/0201181 | A1* | 8/2010 | Pope | E04G 23/006 299/37.1 |

OTHER PUBLICATIONS

Sase Company, "Sase "Cyclone" Battery Powered Floor Scrapper", Retrieved on Jul. 8, 2004, Available at: http://www. sasecompany.com/surface_preparation_equipment/floor_scrapers/fl_cyclone.htm, 1 page.

Sase Company, "Sase "Twister" Propane Powered Floor Scrapper", Retrieved on Jul. 8, 2004, Available at: http://www.sasecompany.com/surface_preparation_equipment/floor_scrapers/fl_twister.htm, 1 page.

Innovatech Products & Equipment Company, "Terminator 2000-ei", Retrieved on Jul. 7, 2004, Available at: http://www.store.yahoo.com/innovatechproducts/te20inbapofl.html, 1 page.

Sase Company, "Sase "Floornado" Electric Floor Scrapper", Retrieved on Jul. 8, 2004, Available at: http://www.sasecompany.com/surface_preparation_equipment/floor_scrapers/fl_floornado.htm, 1 page.

Blastpro Mfg, "Equiptment List", Aug. 14, 2014, 2 pages.

National Surface Preparation Equipment, "Surface Preparation Solutions" CAT#11-1, pp. 29-43; date unknown but before Jun. 21, 2017.

National Flooring Equipment, "Surface Preparation Equipment", 2017, 73 pages.

* cited by examiner

FLOOR STRIPPING MACHINE, BLADE ASSEMBLY FOR USE THEREWITH, AND METHODS

TECHNICAL FIELD

This disclosure relates to a floor stripping machine for stripping materials, such as adhesive bonded floor coverings or any type of floor covering (e.g., ceramic, wood, tile, epoxy and urethane coatings, thin mil coatings, etc.), from floor surfaces; blade assemblies for use with the floor stripping machine; and methods of stripping floor coverings from floor surfaces.

BACKGROUND

Floor stripping machines are known. Many prior art floor stripping machines include a blade assembly that is angled downwardly as it extends toward the floor from a remaining portion of the machine. While this type of machine is effective, heavy forces are needed on the blade assembly for effective use. Among other problems, this required a very heavy machine.

Improvements in the stripping of floor coverings from floor surfaces are desirable.

SUMMARY

In general, a floor stripping machine for removing floor covering from a floor surface is provided that improves the prior art.

A ride-on floor stripping machine for removing floor covering from a floor surface is provided. The floor stripping machine comprising: (a) a base; (b) a motor secured to the base; (c) a rear wheel arrangement driven by the motor; (d) a seat for an operator mounted on the base; (e) a blade assembly secured to a remaining portion of the machine; and wherein the base slopes at a downward angle extending from forward of the rear wheel arrangement in a direction toward the blade assembly, as measured from the floor surface.

In example embodiments, the base slopes at the downward angle from the floor surface of at least 10°.

In one or more embodiments, the base slopes at the downward angle from the floor surface of no greater than 22°.

In some examples, the base slopes at the downward angle from the floor surface of 12-15°.

The base may be spaced from the floor surface to provide an open volume between the base and floor surface of 5-10 inches.

In one or more embodiments, the base is spaced from the floor surface no closer than 5 inches to provide an open volume between the base and floor surface.

The machine may further include a caster wheel supporting the base, the base sloping at the downward angle from forward of the rear wheel arrangement to the caster wheel.

In many examples, the machine may further comprise a handle arrangement for controlling and steering the machine and for locking to increase safety during mounting and dismounting the machine by the operator.

In one or more examples, a blade adjustment arrangement secured to the base and holding the blade assembly in an adjusted position.

In one or more embodiments, an operator leg region is defined between a front edge of the seat and the blade adjustment arrangement, wherein the operator leg region is an obstruction-free open volume, whereby the operator can mount the machine and sit in the seat without having to straddle obstructions between legs and without having to move a leg over any obstructions and without having to use parts of the machine as a ladder to mount the machine.

In some examples, the machine has a center of gravity that is spaced from the floor surface no more than 40% of an overall height of the machine.

In a further aspect, a blade assembly for use with a floor stripping machine is provided; the blade assembly comprising: (a) a clamp having a shank engaging portion and a clamp head; (i) the shank engaging portion defining a dovetail groove constructed and arranged to receive a shank; (ii) the shank engaging portion having a fastener-hole constructed and arranged to receive a fastener; and (b) a cutter secured to the clamp head.

In one or more embodiments, the cutter comprises: (a) a base flange having a forward cutting edge; (b) a pair of side flanges extending from opposite ends of the base flange and against sides of the clamp; the side flanges each having a forward cutting edge; and (c) a hooked section between the side flanges and the base flange.

In some examples, the side flanges each has a forward leaning angle as the side flanges extend from the base flange to free end edges of the side flanges; each forward leaning angle being 4-12°.

In one or more embodiments, the cutter is non-removably secured to the clamp.

In many examples, there further comprises a floor stripping machine, the floor stripping machine comprising: (a) a base; (b) a motor secured to the base; (c) a rear wheel arrangement driven by the motor; and (d) wherein the blade assembly is secured to a remaining portion of the machine.

In a further aspect, a cutter for a blade assembly is provided including: (a) a base flange having a forward cutting edge; (b) a pair of side flanges extending from opposite ends of the base flange and being angled relative to the base flange; the side flanges each having a side flange cutting edge; and (c) a hooked section between each of the side flanges and the base flange.

In many example arrangements, the side flanges each has a forward leaning angle as the side flanges extend from the base flange to free end edges of the side flanges; each forward leaning angle being at least 1°.

In some examples, each of the hooked sections is on a radius of 0.2-0.3 inch.

In one or more embodiments, the base flange has a clamp engaging side and a floor engaging side; the floor engaging side being flat and planar.

In example arrangements, the forward leaning angle is 4-12°.

In another aspect, a ride-on floor stripping machine for removing floor covering from a floor surface is provided; the floor stripping machine comprising: (a) a base; (b) a motor secured to the base; (c) a rear wheel arrangement driven by the motor; (d) a seat for an operator mounted on the base; (e) a blade adjustment arrangement secured to the base; (f) a blade assembly held by the blade adjustment arrangement; and (g) an operator leg region defined between a front edge of the seat and the blade adjustment arrangement, wherein the operator leg region is an obstruction-free open volume, whereby the operator can mount the machine and sit in the seat without having to straddle obstructions between legs and without having to move a leg over any obstructions.

In one or more embodiments, the blade adjustment arrangement includes at least a hydraulic cylinder to apply force to the blade assembly against the floor surface.

In some examples, the blade adjustment arrangement further includes a slide plate arrangement to permit adjustment of the blade assembly relative to the floor surface, without requiring the operator to dismount the machine to do the adjustment.

The machine may further comprise a planar front plate extending between the seat and the base.

In example arrangements, the base is spaced from the floor surface no closer than 5 inches to provide an open volume between the base and floor surface.

In one or more embodiments, the base slopes at a downward angle extending from forward of the rear wheel arrangement in a direction toward the blade assembly, as measured from the floor surface, of 10-22°.

In some examples, the blade assembly includes a shank secured to the base, the shank having a dovetail; and wherein the clamp includes a dovetail groove slidably mounted on the dovetail of the shank.

In a further aspect, a ride-on floor stripping machine for removing floor covering from a floor surface is provided; the floor stripping machine comprising: (a) a base; (b) a motor secured to the base; (c) a rear wheel arrangement driven by the motor; (d) a seat for an operator mounted on the base; (e) a blade assembly secured to a remaining portion of the machine; and wherein the machine has a center of gravity that is spaced from the floor surface no more than 40% of an overall height of the machine.

In some examples, the center of gravity is spaced from the floor no more than 36% of an overall height of the machine.

In one or more embodiments, the base is spaced from the floor surface no closer than 5 inches to provide an open volume between the base and floor surface.

In example arrangements, the base slopes at a downward angle extending from forward of the rear wheel arrangement in a direction toward the blade assembly, as measured from the floor surface, of 10-22°.

In one or more embodiments, the machine has a horsepower of at least 3.

In some examples, the machine has a weight of no more than 900 pounds.

In another aspect, a floor stripping machine for removing floor covering from a floor surface is provided; the floor stripping machine comprising: (a) a base; (b) a motor secured to the base; (c) a rear wheel arrangement driven by the motor; and (d) a blade assembly secured to a remaining portion of the machine; the blade assembly including, (i) a shank secured to the base, the shank having a dovetail; (ii) a removable clamp with a cutter, the clamp having a dovetail groove slidably mounted on the dovetail of the shank.

In example arrangements, the cutter has a bottom oriented to lie either flat on the floor surface or angling from the floor surface no more than 10°.

In one or more embodiments, the blade assembly further includes a fastener securing the shank and clamp together.

In some examples, the cutter comprises a base flange having a forward cutting edge, and a plurality of openings therethrough; a clamp-engaging side, and a floor engaging side; and the blade assembly further includes a plurality of bolts extending from the floor engaging side, through the openings, and into the clamp to removably secure the cutter to the clamp.

In one or more embodiments, the cutter further includes a pair of side flanges extending from opposite ends of the base flange and against sides of the clamp; the side flanges each having a forward cutting edge.

In some arrangements, there is a hooked section between the side flanges and the base flange.

In one or more embodiments, the cutter is non-removably secured to the clamp.

In some examples, the cutter is narrower in width than a remaining portion of the clamp.

In example arrangements, the clamp includes a clamp head adjacent to the dovetail, the clamp head sloping downwardly from a top of the clamp in a direction toward the cutter.

In many examples, the machine further comprises a blade adjustment arrangement secured to the base and holding the blade assembly in an adjusted position; the blade adjustment arrangement including at least a hydraulic cylinder to apply force to the blade assembly against the floor surface.

In one or more embodiments, the blade adjustment arrangement further includes a slide plate arrangement to permit adjustment of the blade assembly relative to the floor surface.

In some example arrangements, there is also a seat for an operator mounted on the base.

Many arrangements further comprise a handle arrangement for controlling and steering the machine.

In some examples, there is a weight arrangement secured to the base between the rear wheel arrangement and the blade adjustment arrangement.

In some examples, the base slopes at a downward angle extending from forward of the rear wheel arrangement in a direction toward the blade assembly, as measured from the floor surface.

In example arrangements, the base slopes at the downward angle from the floor surface of at least 10°.

In one or more embodiments, the base slopes at the downward angle from the floor surface of no greater than 22°.

In example embodiments, there further comprises: (a) a seat for an operator mounted on the base; and (b) an operator leg region defined between a front edge of the seat and the blade adjustment arrangement, wherein the operator leg region is an obstruction-free open volume, whereby the operator can mount the machine and sit in the seat without having to straddle obstructions between legs and without having to move a leg over any obstructions.

In another aspect, a method of stripping a floor covering from a floor surface is provided. The method comprising: driving a machine having a base, a motor secured to the base, a seat mounted to the base, and a rear wheel arrangement driven by the motor to push a blade assembly along a floor surface and sheer the floor covering from the floor surface; and the base slopes at a downward angle extending from forward of the rear wheel arrangement in a direction toward the blade assembly, as measured from the floor surface.

In example methods, before the step of driving, there is a step of mounting the machine by sitting in the seat without straddling obstructions and without having to use parts of the machine as a ladder or having to move a leg over any obstructions.

A variety of additional inventive aspects will be set forth in the description that follows. The inventive aspects can relate to individual features and to combinations of features. It is to be understood that both the forgoing general description and the following detailed description are exemplary and explanatory only and are not restrictive of the broad inventive concepts upon which the embodiments disclosed herein are based.

BRIEF DESCRIPTION OF THE DRAWINGS

The accompanying drawings, which are incorporated herein, constitute a part of the description and illustrate several aspects of the present disclosure. A brief description of the drawings is as follows.

DETAILED DESCRIPTION

Figure 1:
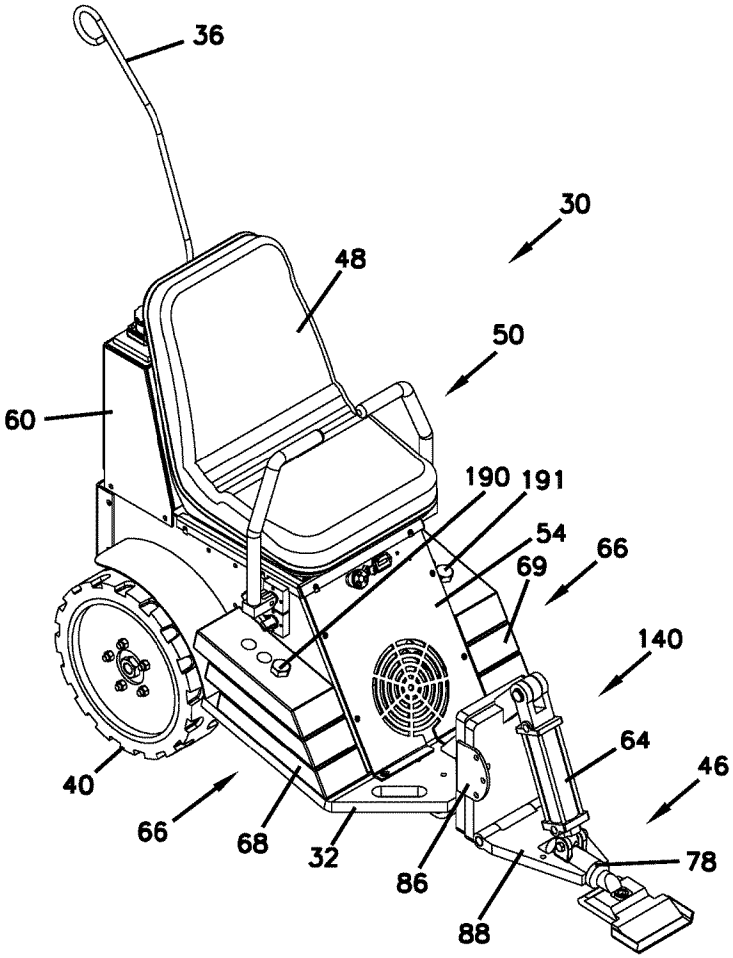
FIG. 1 is a perspective view of an embodiment of a floor stripping machine, constructed in accordance with principles of this disclosure.
Figure 2:
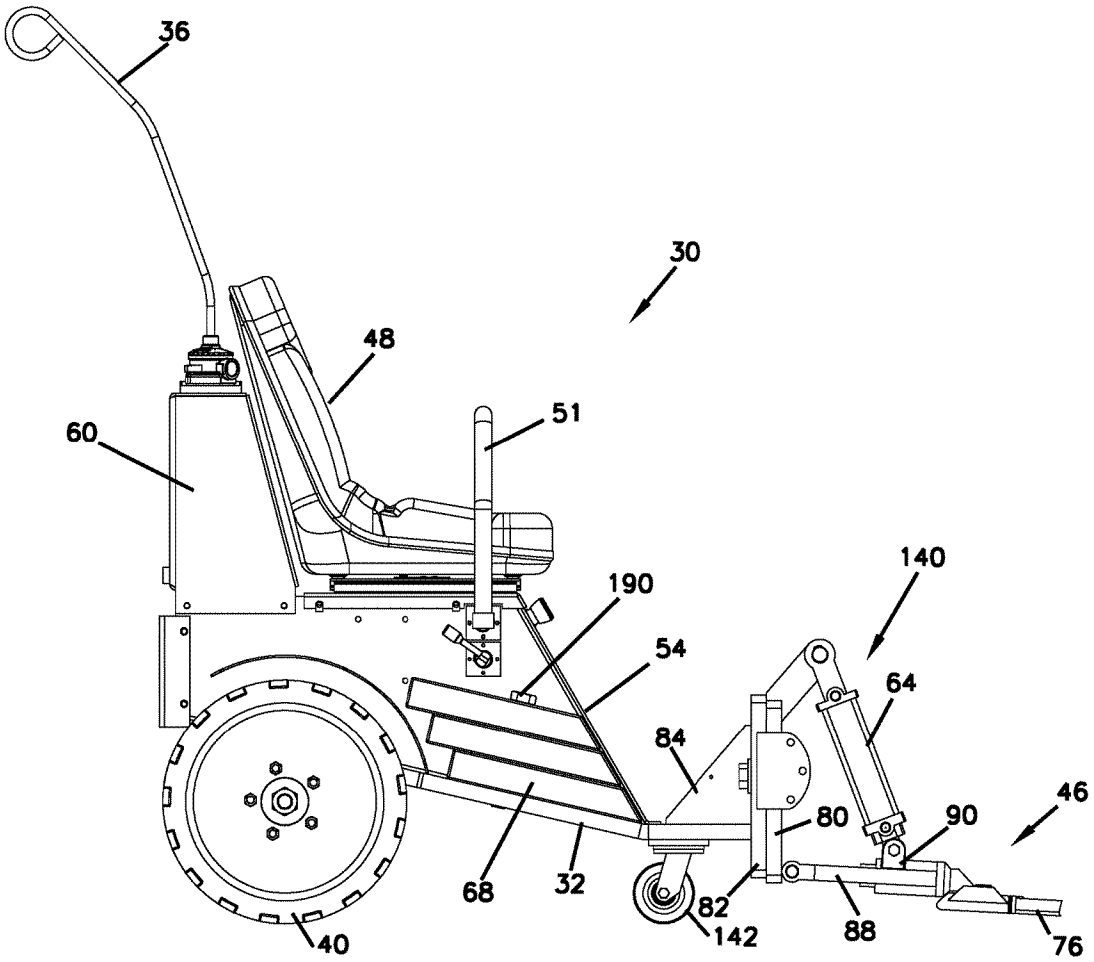
FIG. 2 is a side view of the floor stripping machine of FIG. 1.
Figure 3:
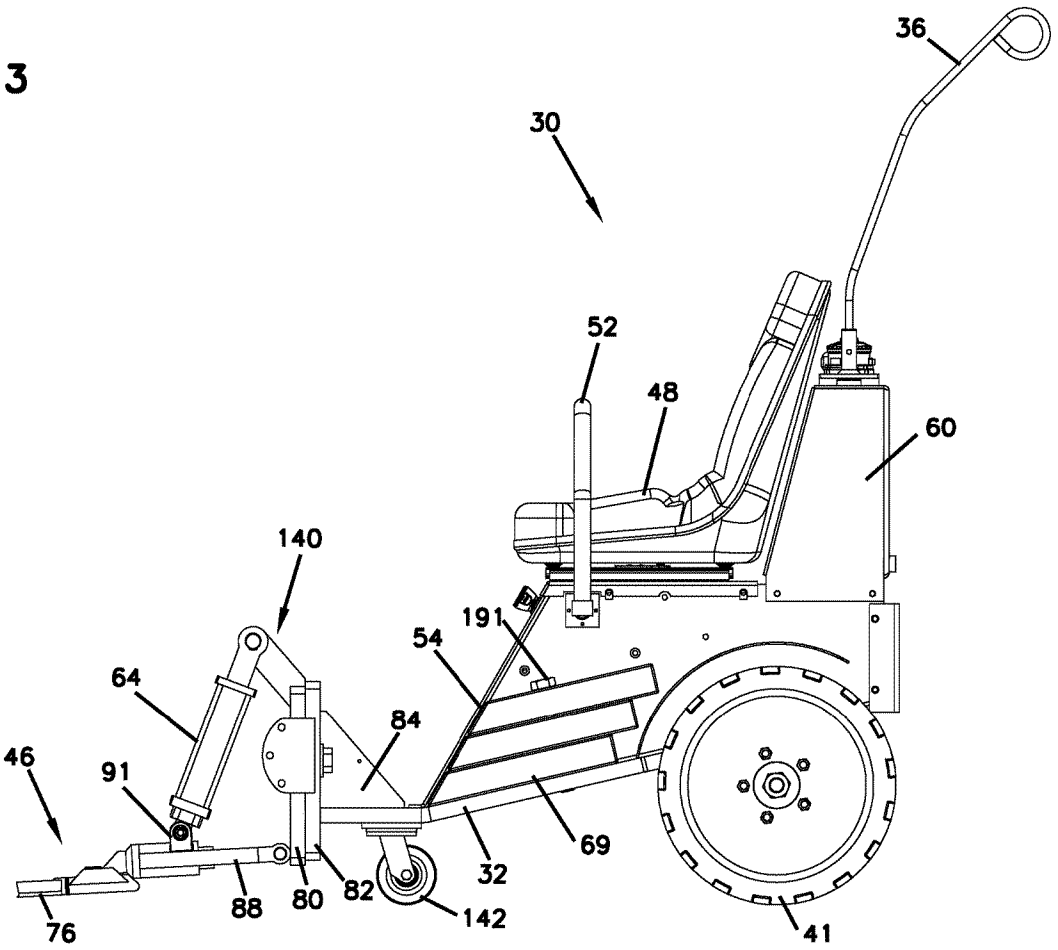
FIG. 3 is an opposite side view of the floor stripping machine of FIG. 2.
Figure 5:
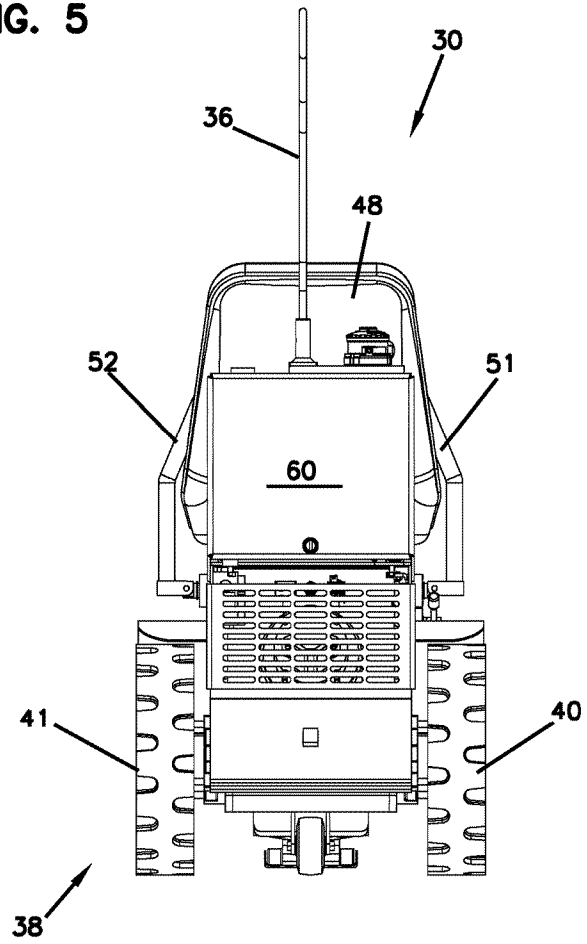
FIG. 5 is a rear view of the floor stripping machine of FIG. 1.
Figure 4:
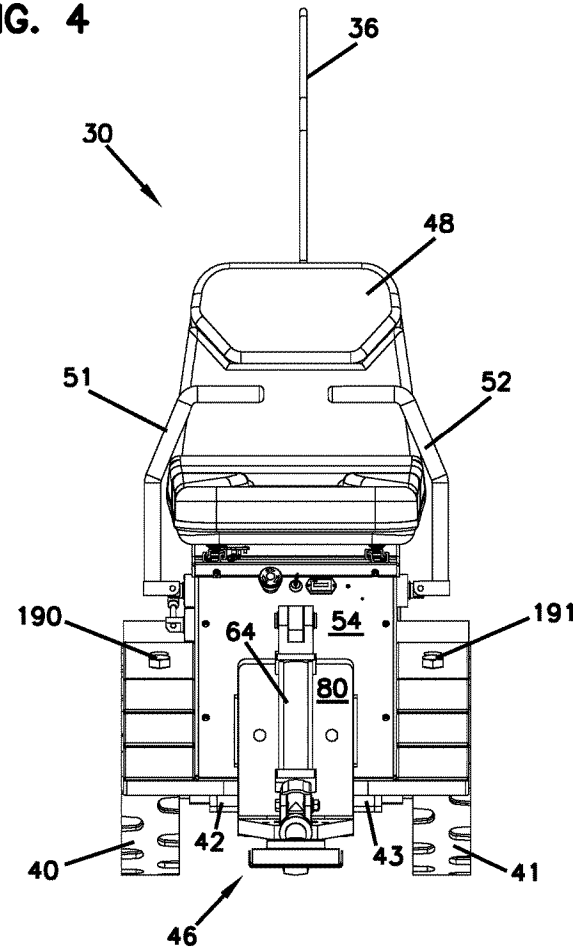
FIG. 4 is a front view of the floor stripping machine of FIG. 1.
Figure 6:
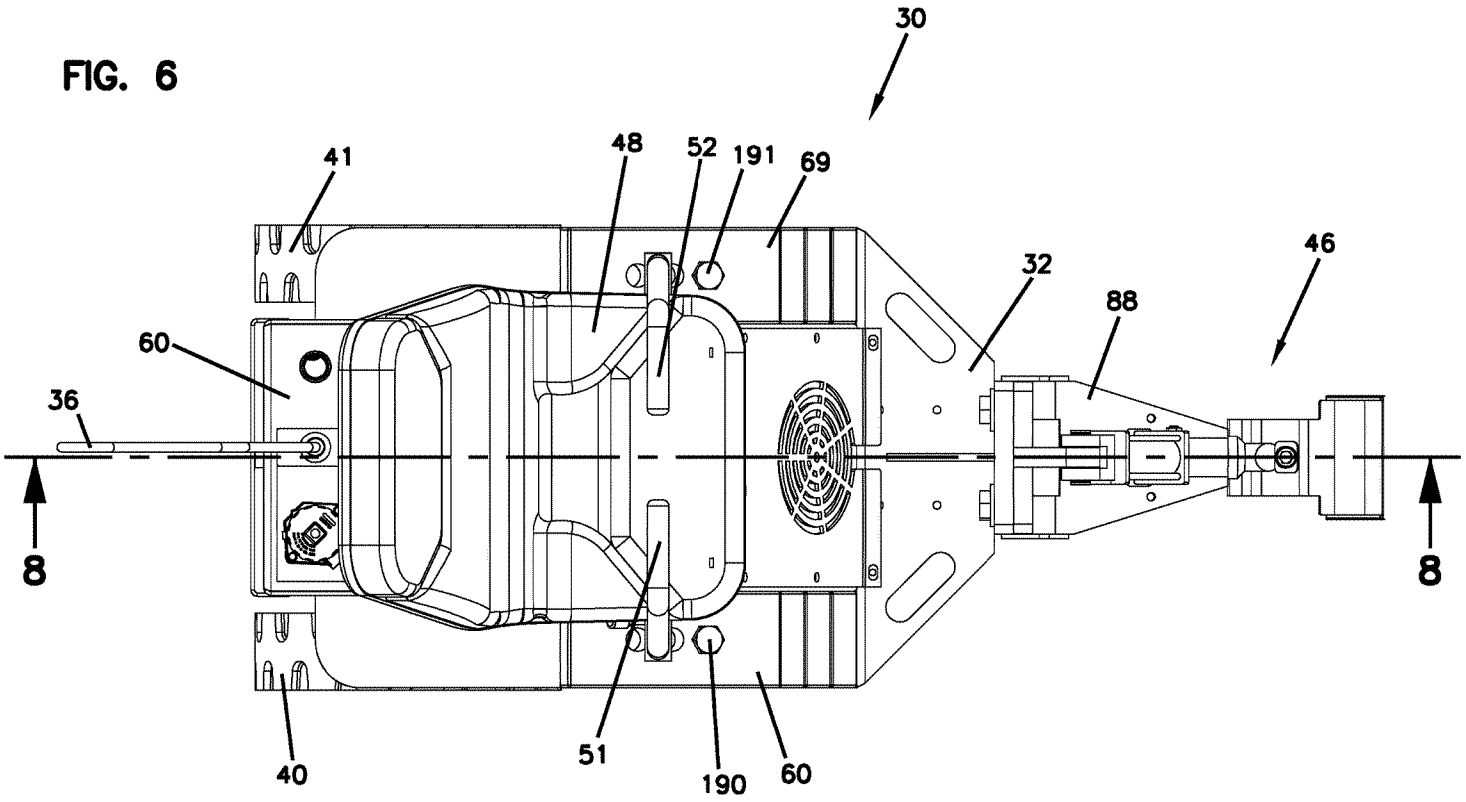
FIG. 6 is a top view of the floor stripping machine of FIG. 1.
Figure 7:
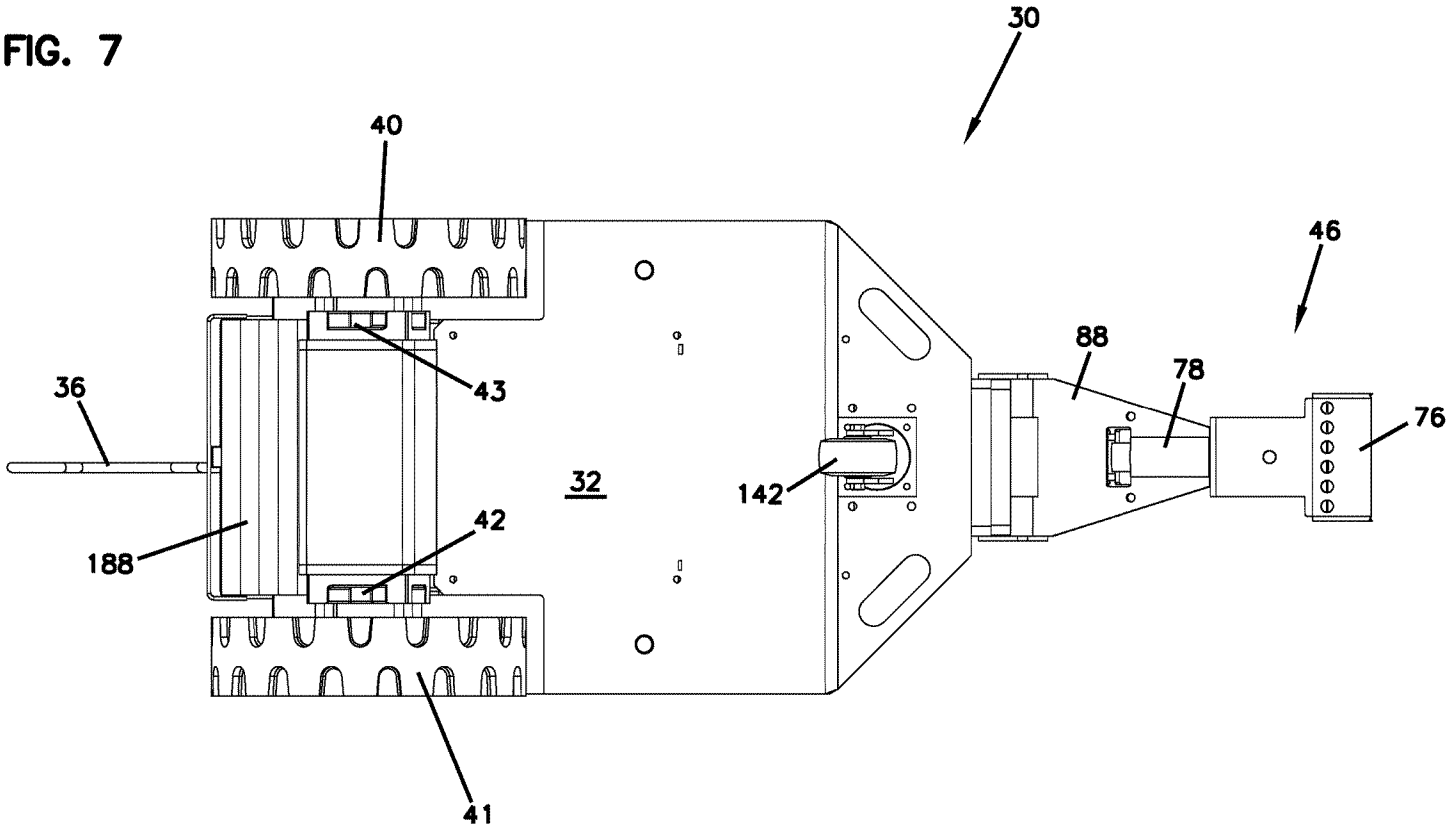
FIG. 7 is a bottom view of the floor stripping machine of FIG. 1.
Figure 8:
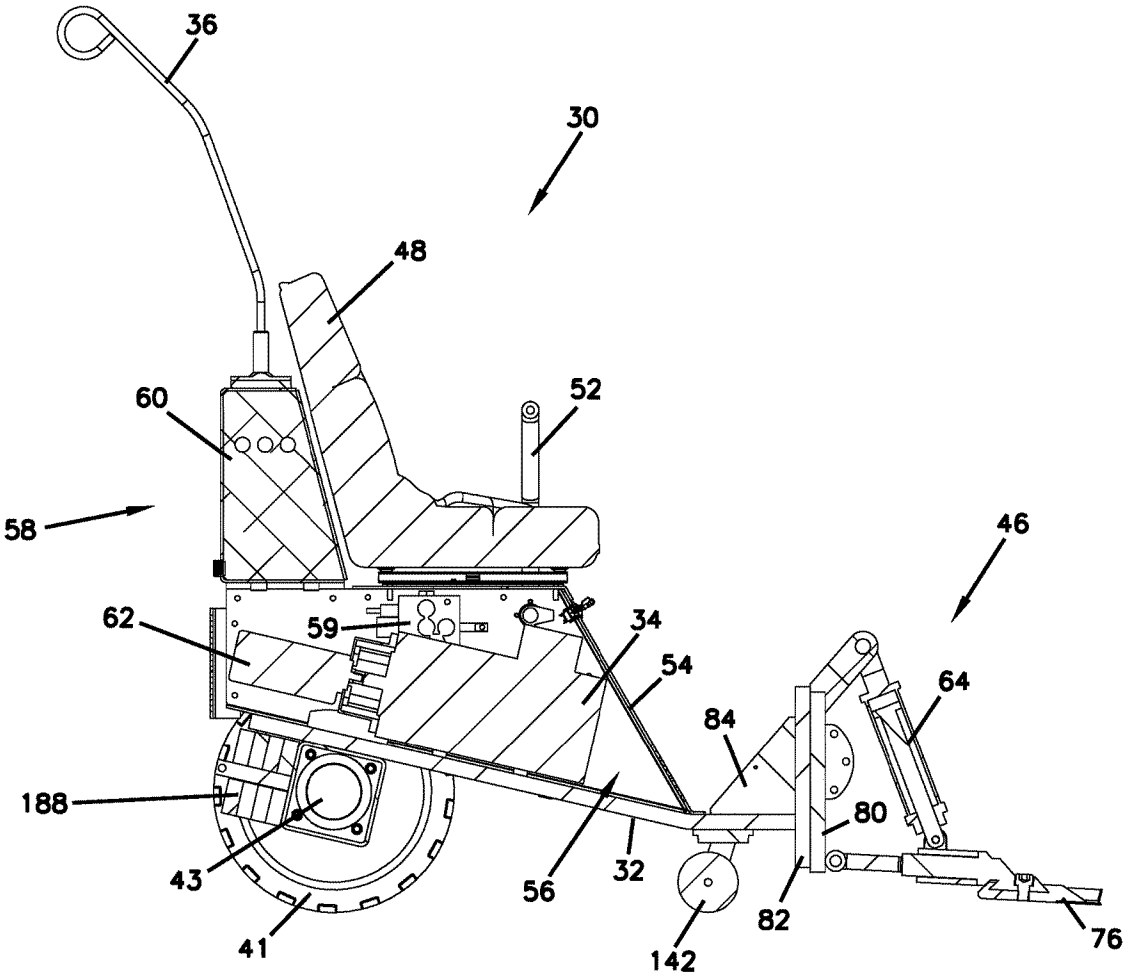
FIG. 8 is a cross-sectional view of the floor stripping machine of FIG. 1, the cross-section being taken along the line 8-8 of FIG. 6.
Figure 9:
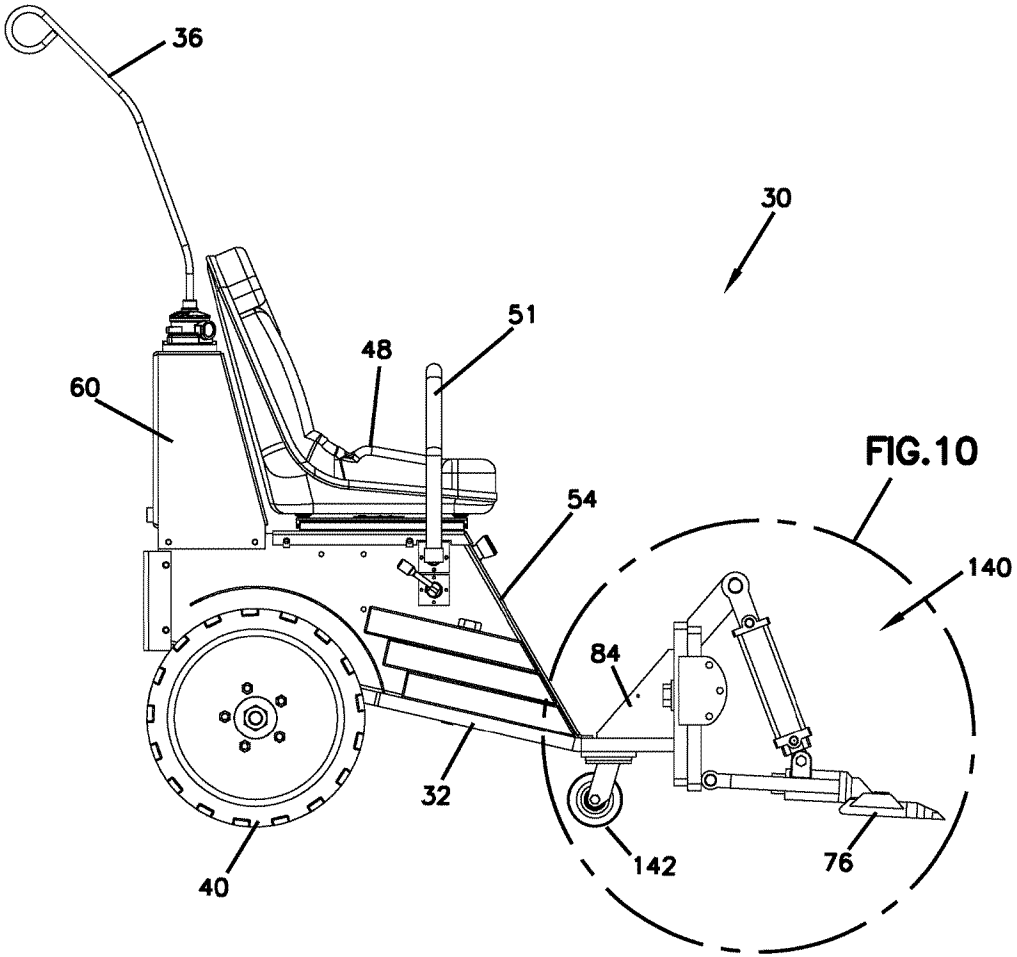
FIG. 9 is another side view of the floor stripping machine, similar to the view of FIG. 2, but showing an alternative blade assembly.

A. Summary of Overall Machine, FIGS. 1-9, 28 & 29

A floor stripping machine 30 is shown in general in FIGS. 1-9. The floor stripping machine 30 can be used to remove all types of flooring materials such as, commercial carpet, wood, ceramic, gummy adhesives, vinyl, rubber tile, sheet rubber, indoor and outdoor sports surfaces, roofing material, linoleum, cementitious self-levelers, gypsum, epoxy, and poly aspartics. The floor stripping machine 30 is a "ride on" machine 30, in that the operator of the machine 30 is positioned on the machine 30 to control operation. In this example, the operator is in a seated position, described further below.

The floor stripping machine 30 includes a base 32. The base 32 is generally a frame or chassis, which can be made from a strong, supportive material such as metal, including steel. As will be discussed further below, the base 32 cooperates with the rest of the machine 30 to form a downwardly sloping angle to the overall machine 30, which provides advantages. This is discussed in Section C below.

In this embodiment, there is a motor 34 (FIG. 8) secured to the base 32. The motor 34 can be a DC motor. In other embodiments, the motor 34 can be an AC motor, a propane engine, or a diesel engine. The DC motor 34 can be connected to electricity using a cord (not shown). A cord arm 36 projecting vertically above a remaining portion of the machine 30 can be used to help hold the cord and prevent the machine 30 from driving over the cord. In addition, instead of an engine, batteries could be used.

The floor stripping machine 30 further includes a rear wheel arrangement 38 driven by the motor 34. As can be seen in FIGS. 4, 5, 7, and 8, the rear wheel arrangement includes first and second wheels 40, 41 on opposite sides of the base 32. The first and second wheels 40, 41 are driven by wheel motors 42, 43 (FIG. 7) which are driven hydraulically by the prime mover main DC motor 34.

The floor stripping machine 30 further includes a blade assembly 46. The blade assembly 46 is secured to a remaining portion of the machine 30. The blade assembly 46 is constructed and arranged to shear, cut, or skive a floor covering from a floor surface. More details on the blade assembly 46 are described further below, following further description of the example embodiment of the rest of the floor stripping machine 30.

The floor stripping machine 30 includes a seat 48 for an operator to be seated while controlling the machine 30. Flanking the seat 48 on opposite sides of the seat 48 is a handle arrangement 50. The handle arrangement 50 includes first and second handles 51, 52. The first handle 51 controls the first wheel 40, while the second handle 52 controls the second wheel 41. The handles 51, 52 control the wheels 40, 41 and direct the machine in a skid steer fashion allowing for a high degree of maneuverability and precise control. They may also be locked to prevent the machine from moving while in an open position (FIG. 29) during mounting and dismounting for increased safety.

Figure 28:
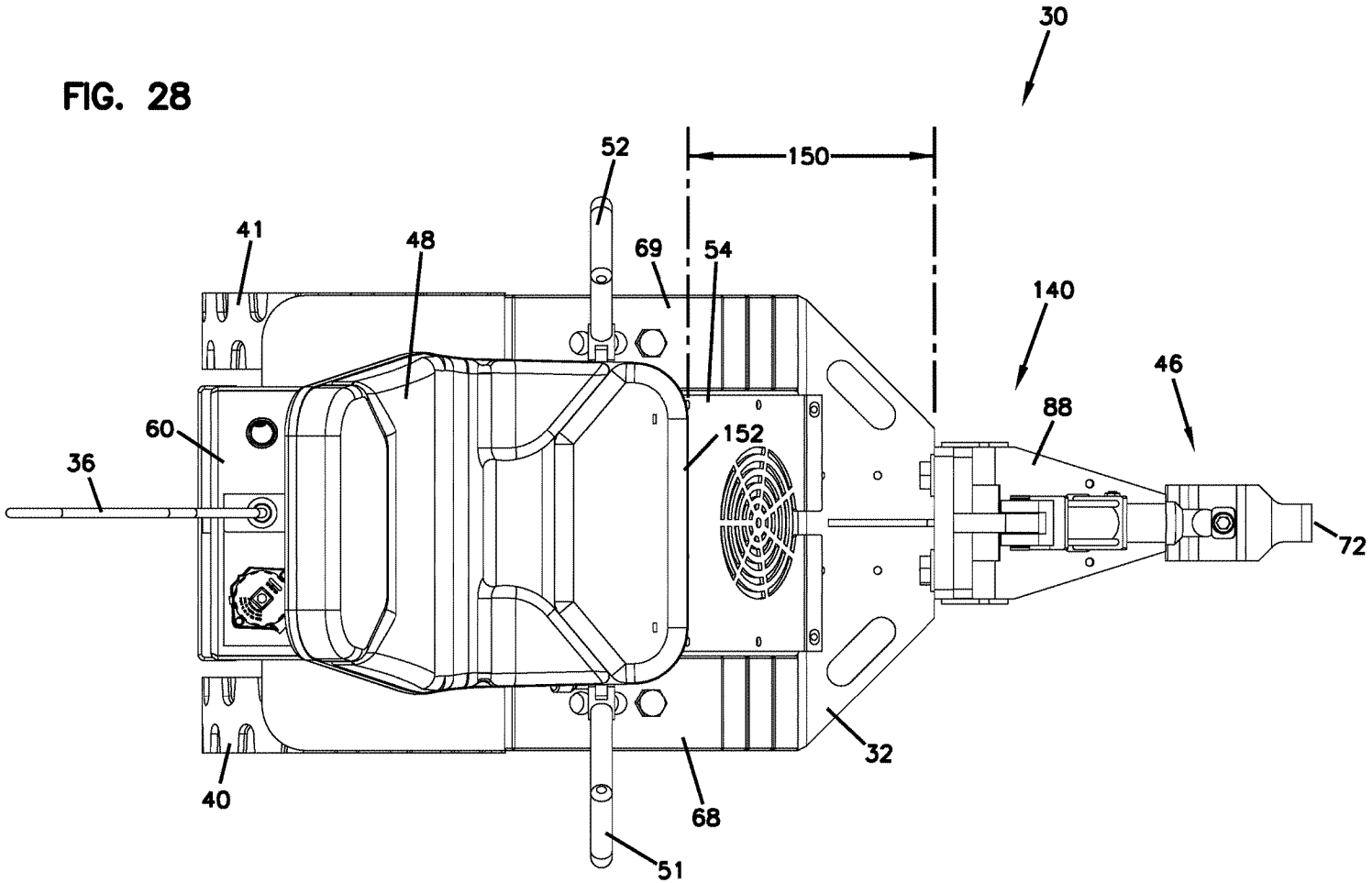
FIG. 28 is a top view of the floor stripping machine, similar to the view of FIG. 6, but showing the steering handles tilted radially outwardly from the machine for easy access by the operator.
Figure 29:
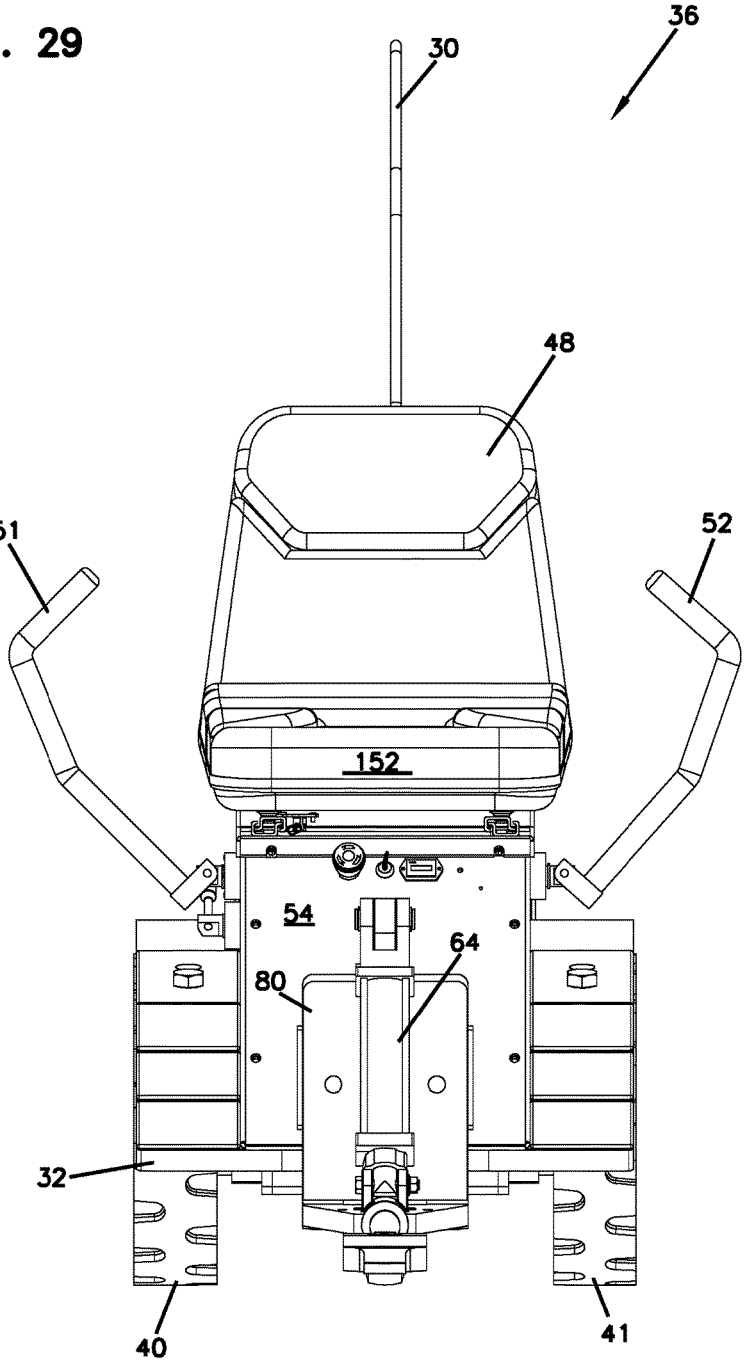
FIG. 29 is a front view of the floor stripping machine, similar to the view of FIG. 4, and showing the front view of FIG. 28 with the steering handles tilted outwardly from the machine for easy access by the operator.

One of the features of the floor stripping machine 30 can be appreciated by reviewing FIGS. 28 and 29. The seat 48 is easily accessible by the machine operator, as it is open from the front and sides of the seat 48. Accessibility to the seat 48 is obstacle-free; e.g., it is free of blade assemblies, motors, engines, weights, and other machine components. In FIGS. 28 and 29, the handles 51, 52 are shown tilted away from a remaining portion of the machine 30. An operator can easily step into and out of the seat 48 from the side and front of the machine 30, unobstructed. The operator does not need to swing his legs over any obstacles or portions of the machine. An operator leg region 150 (FIG. 28) is defined between a front edge 152 of the seat 48 and a blade adjustment arrangement 140 (described below), wherein the operator leg region 150 is an obstruction-free open volume, whereby the operator can mount the machine 30 and sit in the seat 48 without having to straddle obstructions between legs and without having to move a leg over any obstructions. The operator is not required to use the machine 30 as a ladder to climb on and access the machine 30.

A front panel 54 extends from the seat 48 down to the base 32. The front panel 54 hides and protects the interior volume 56 (FIG. 8) of the machine 30. Located in the interior volume 56 is the DC motor 34 and other components, discussed below. The front panel 54 can be substantially planar, and free of obstructions that would interfere with an operator's legs.

The floor stripping machine 30 further includes an open loop hydraulic system 58. The hydraulic system 58 is for controlling adjustment of the blade assembly 46 and driving the wheels 40 and 41. In this embodiment, the hydraulic system 58 includes a hydraulic tank 60 holding hydraulic fluid. A hydraulic pump 62 (FIG. 8) is located in the interior volume 56. The hydraulic system also includes two manually actuated directional control valves (one shown at 59 in FIG. 8); wheel motors 42, 43; and a hydraulic cylinder 64, which is used to control the blade assembly 46 (discussed further below). The hydraulic tank 60 and pump 62 are connected with hoses, not shown. The pump 62 is further connected to the directional control valves 59. The directional control valves 59 are further connected to the hydraulic cylinder 64 which is used to control the blade assembly 46 and the hydraulic wheel motors 42, 43 which are used to drive the wheels 40 and 41. Alternatives are possible including, for example a closed loop hydraulic system employing a hydrostat.

The floor stripping machine further includes a weight arrangement 66. The weight arrangement 66 is secured to the base 32 between the rear wheel arrangement 38 and the blade assembly 46. In this embodiment, the weight arrangement 66 includes first and second stacks 68, 69 of weights on opposite sides of the front panel 54, below the seat 48 and forward of the first and second wheels 40, 41. The weights 68, 69 add weight to the machine 30 to help with applying force to the blade assembly 46, and in addition, they help to give weight to the wheels 40, 41. In this embodiment, the weights 68, 69 have a plurality of through holes that receive a bolt 190, 191 to secure the weights 68, 69. The weights 68, 69 are universal, in that they may stacked in any order on the machine 30, and then secured with the bolts 190, 191.

In addition, there is an optional weight stack 188 (FIGS. 7 and 8) located at the rear of the machine and between the wheels 40, 41. The purpose of the optional weight stack 188 is to add traction to the machine.

Figure 20:
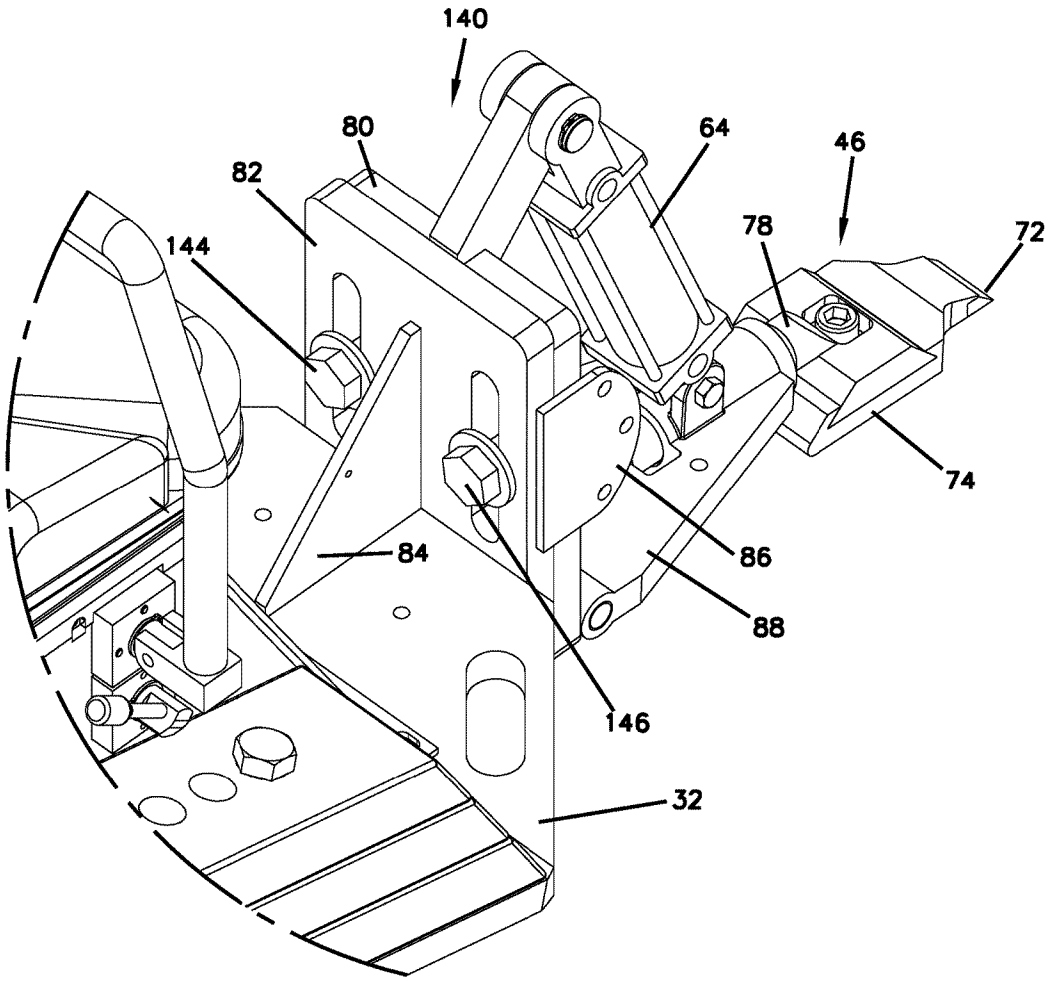
FIG. 20 is a rear perspective view of FIG. 19.
Figure 21:
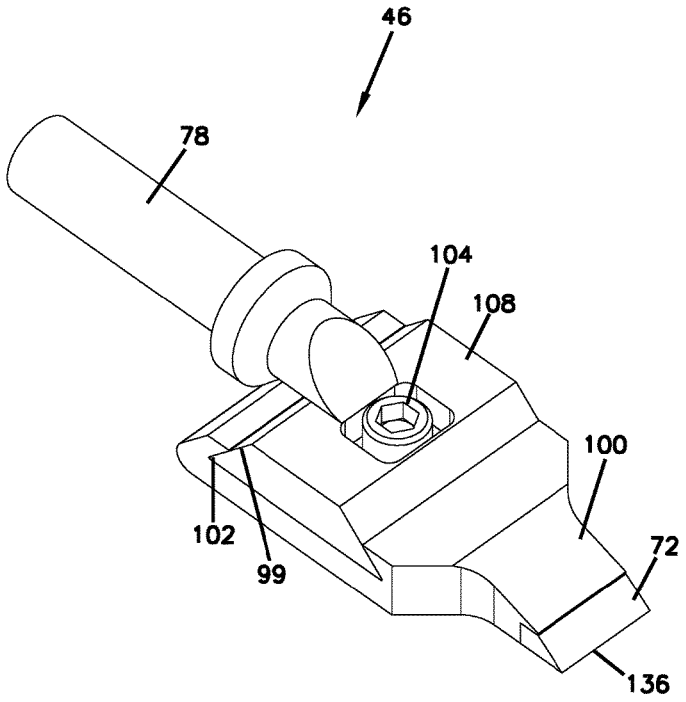
FIG. 21 is a perspective view of a second embodiment of the blade assembly and shown in FIGS. 9, 10, 19, and 20.
Figure 22:
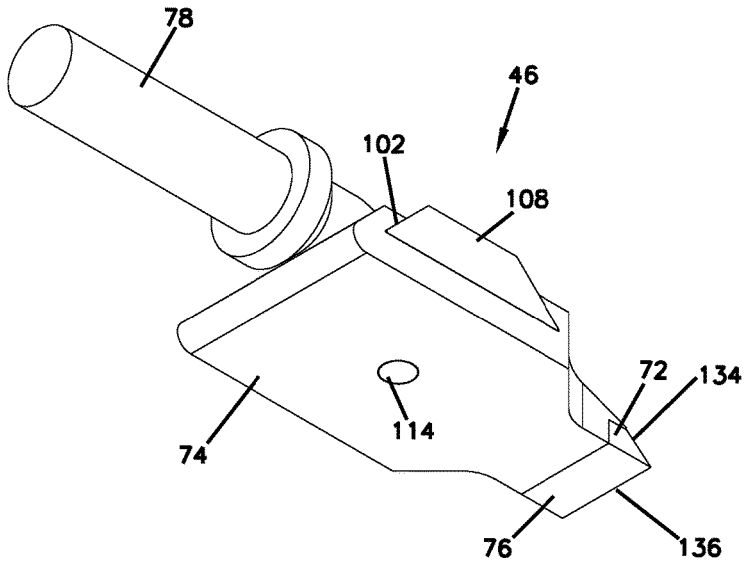
FIG. 22 is a bottom perspective view of the blade assembly of FIG. 21.
Figure 23:
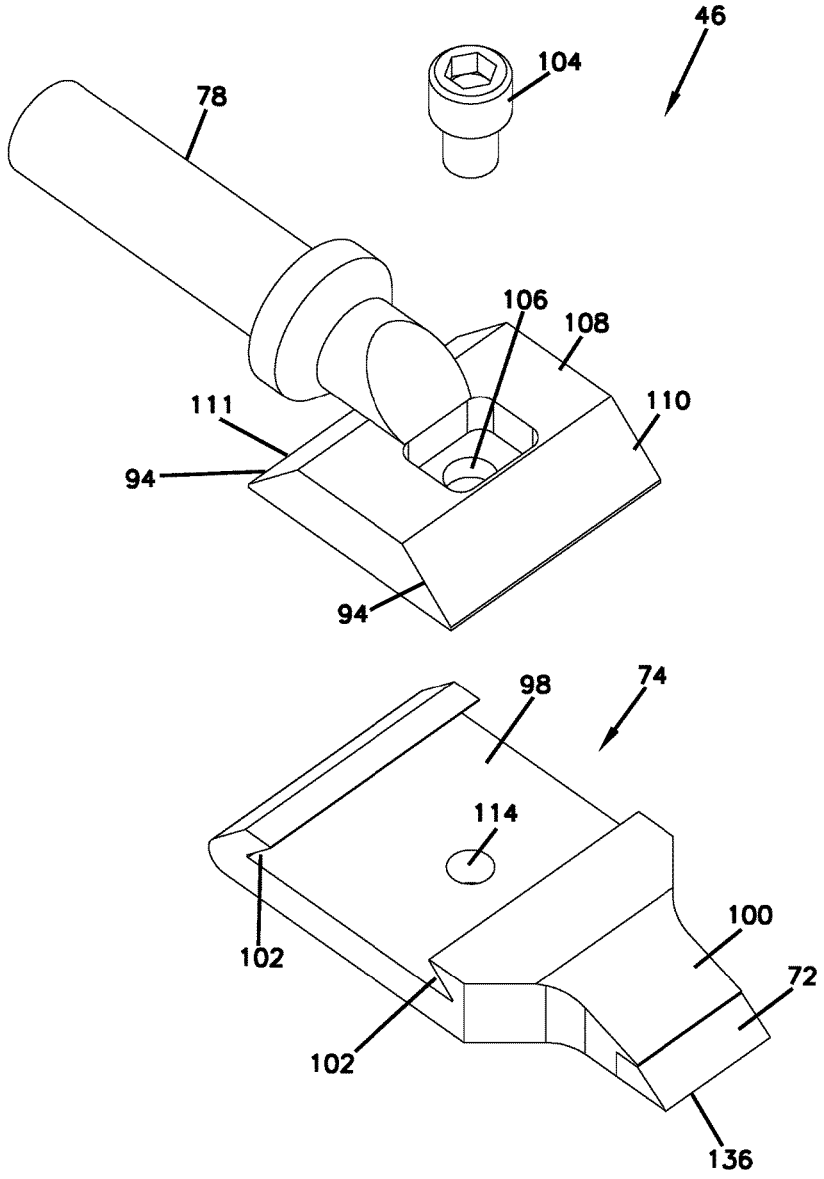
FIG. 23 is a top, exploded perspective view of the blade assembly of FIG. 21.
Figure 24:
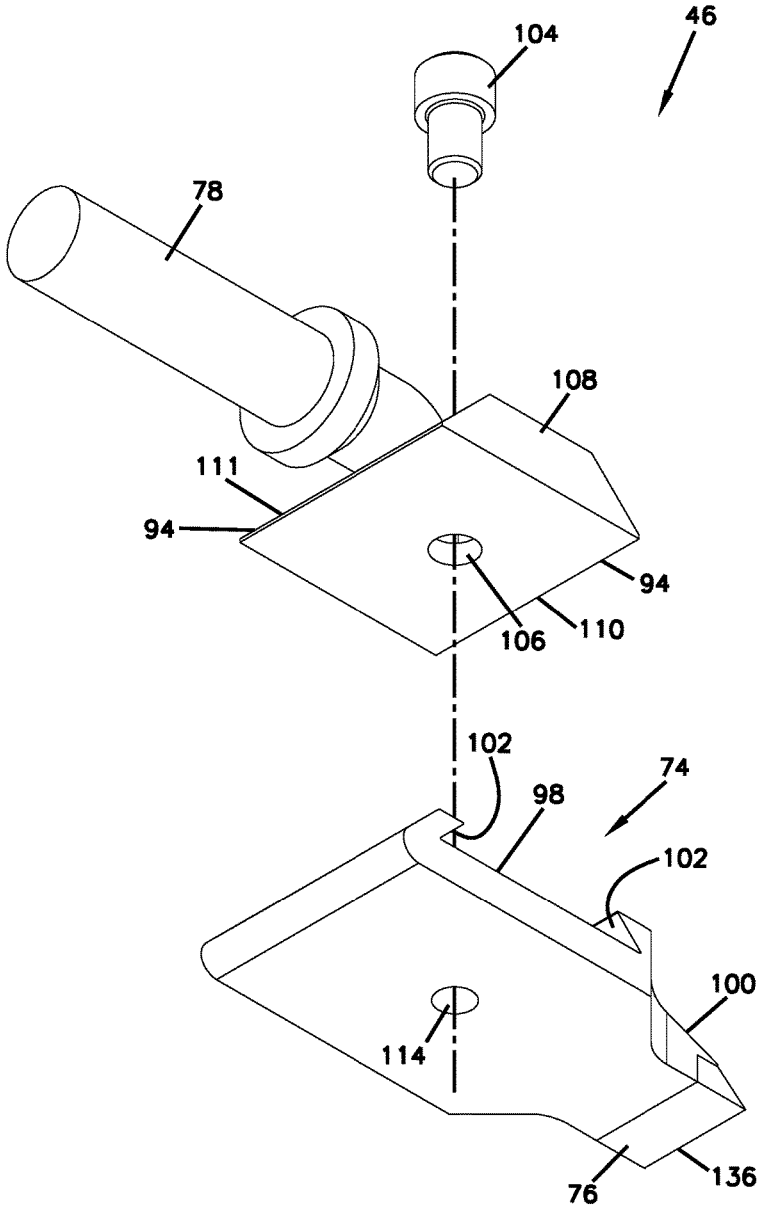
FIG. 24 is a bottom, exploded perspective view of the blade assembly of FIG. 21.

The blade adjustment arrangement 140, mentioned above in connection with the operator leg region 150 (FIG. 28) is secured to the base 32 and holds the blade assembly 46 in the desired adjusted position. The blade adjustment arrangement 140 can include the hydraulic cylinder 64. The hydraulic cylinder 64 applies force to the blade assembly 46 and against the floor surface. The blade adjustment arrangement 140 can also include a slide plate 80. The slide plate 80 can be vertically adjusted relative to a slide support 82 (which is secured to the base 32) in order to adjust the blade assembly 46 into the desired position. FIG. 20 shows bolts 144, 146 that extend between the slide support 82 and slide plate 80, which can be loosened to vertically adjust the slide plate 80 and then tightened when in the desired position.

Figure 10:
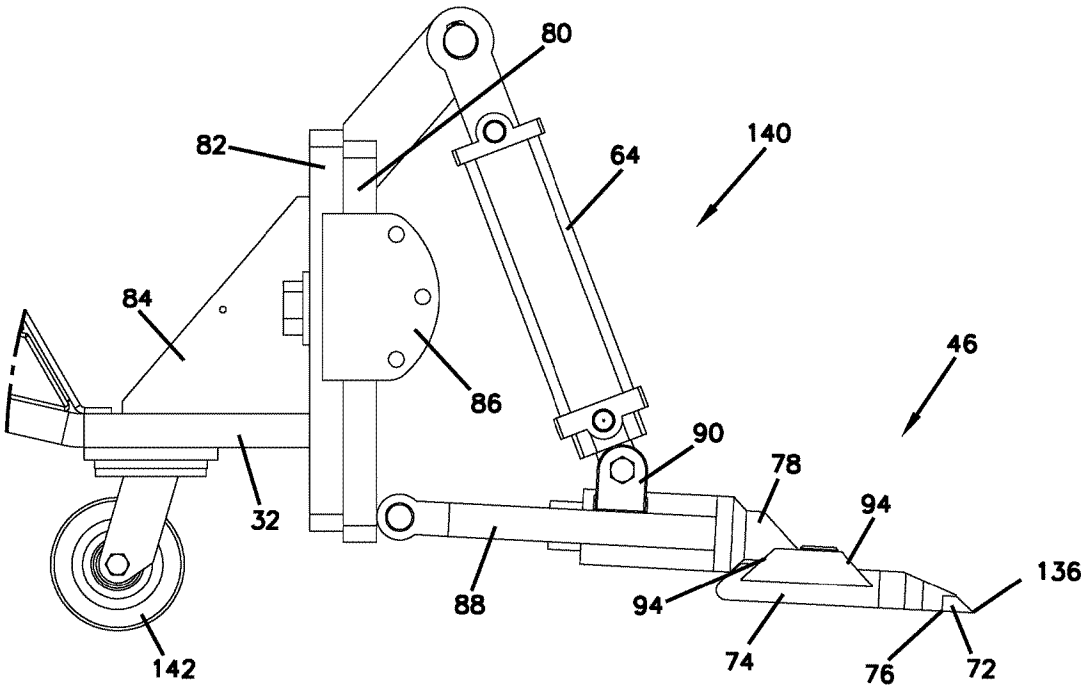
FIG. 10 is an enlarged view of the blade assembly shown at portion A of FIG. 9.
Figure 11:
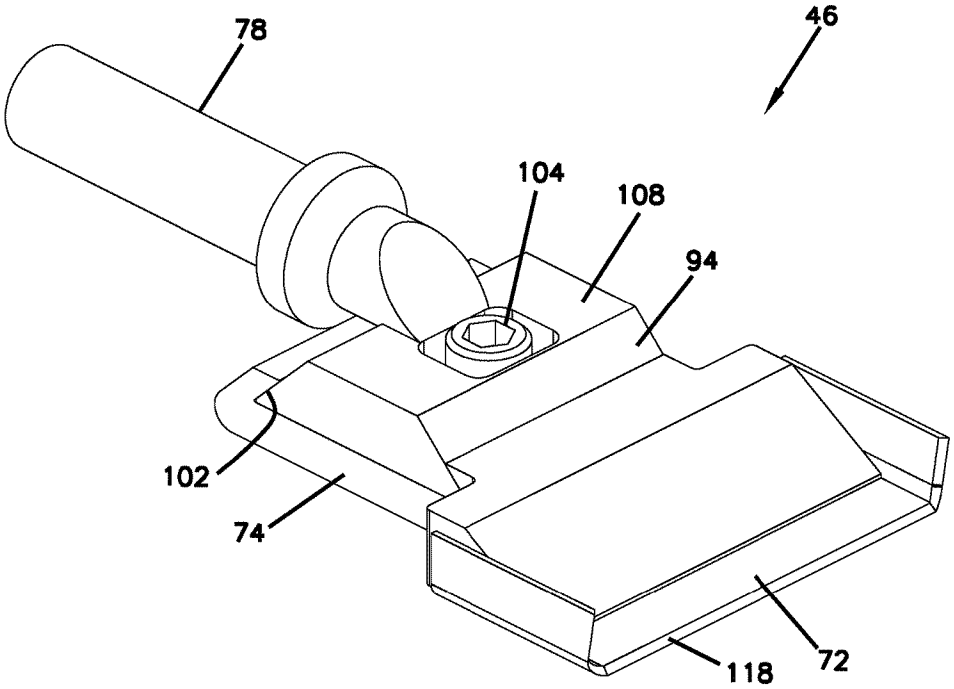
FIG. 11 is a perspective view of a first embodiment of a blade assembly usable with the floor stripping machine of FIGS. 1-9.
Figure 12:
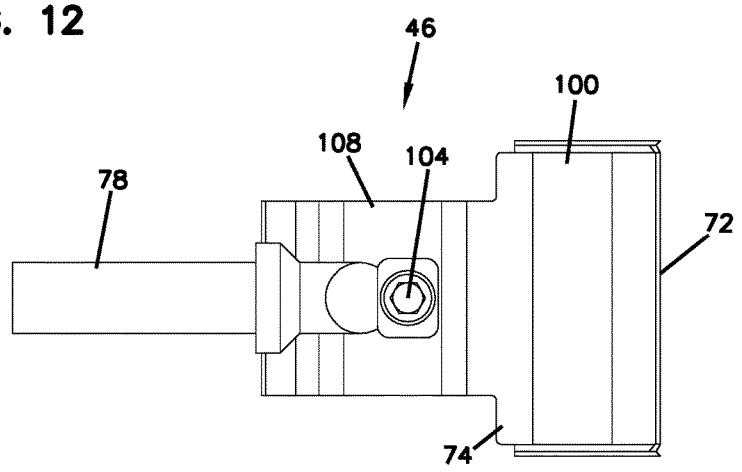
FIG. 12 is a top view of the blade assembly of FIG. 11.
Figure 13:
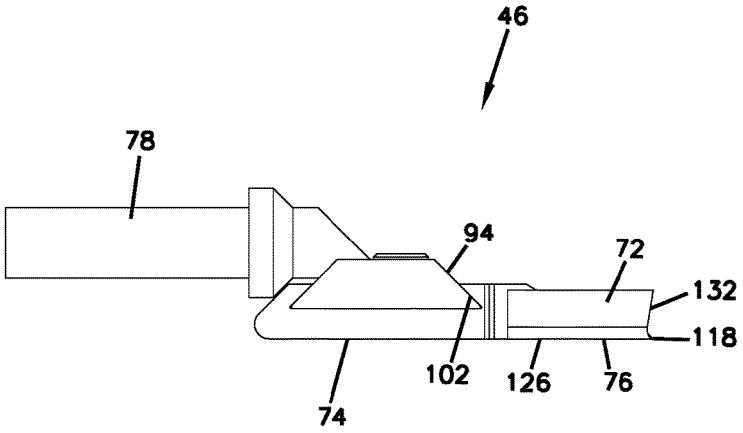
FIG. 13 is a side view of the blade assembly of FIG. 11.
Figure 14:
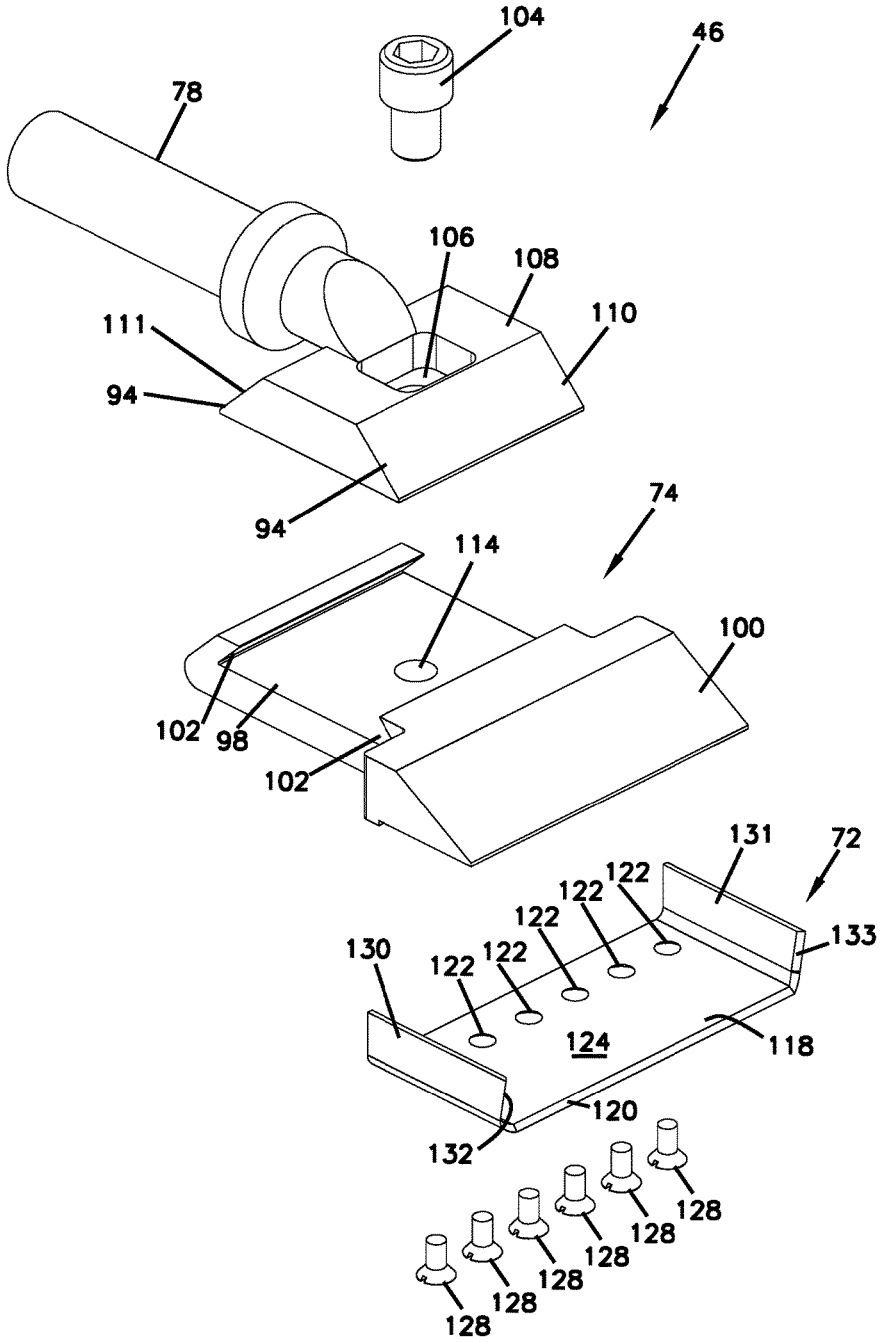
FIG. 14 is a top, exploded perspective view of the blade assembly of FIG. 11.
Figure 15:
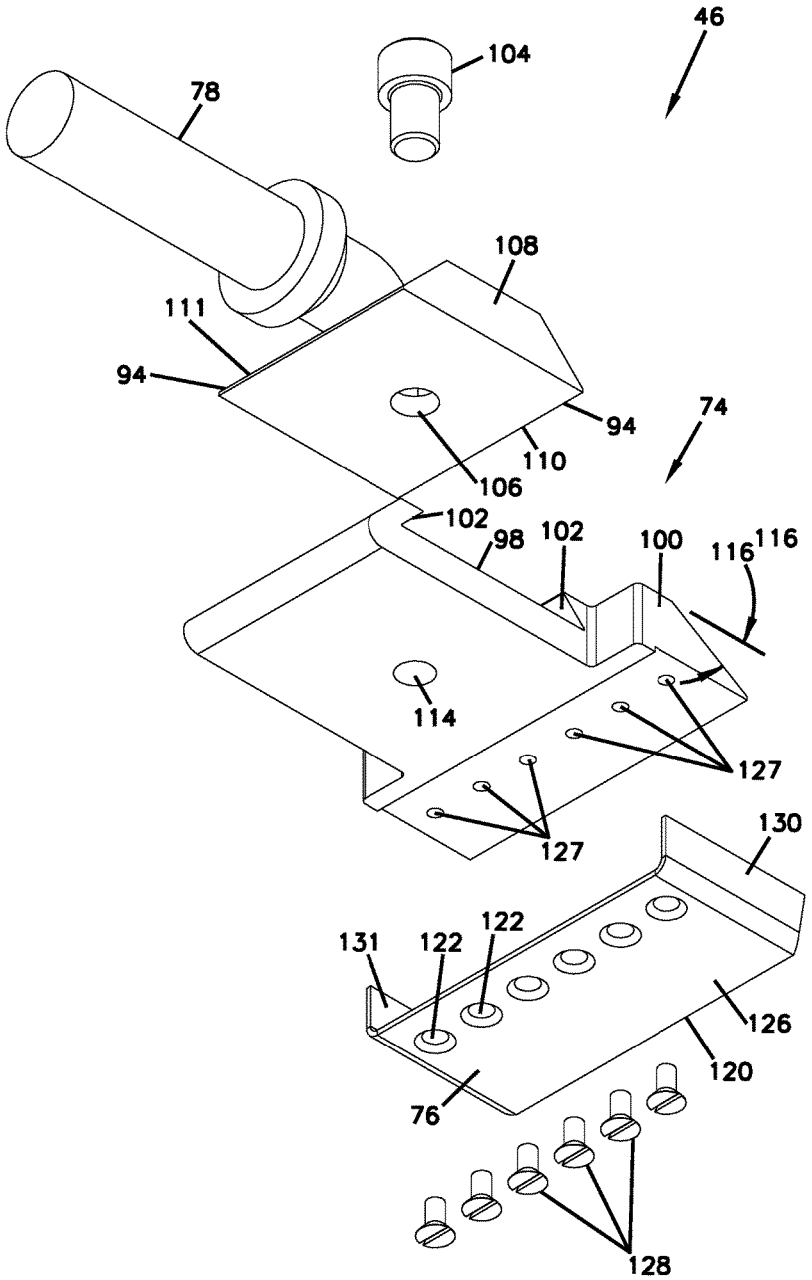
FIG. 15 is a bottom, exploded perspective view of the blade assembly of FIG. 11.
Figure 16:
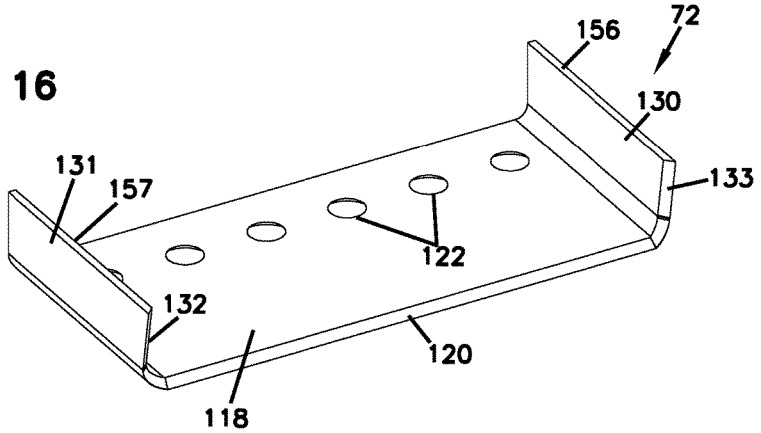
FIG. 16 is a perspective view of a cutter used in the blade assembly of FIG. 11.
Figure 17:
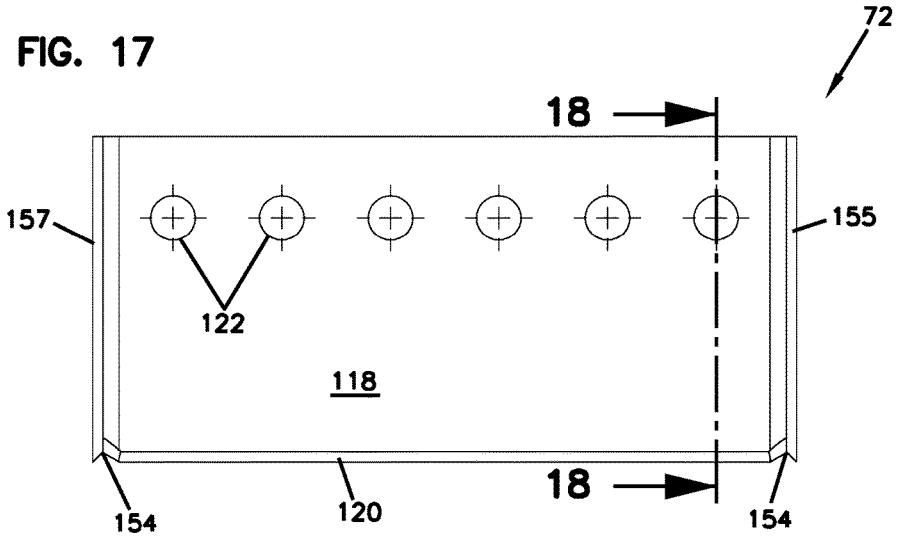
FIG. 17 is a top view of the cutter of FIG. 16.

A gusset plate 84 helps to support the slide support 82 and extends from the slide support 82 to the base 32. In this embodiment, the gusset plate 84 is generally perpendicular to the slide support 82 and to the base 32. As can be appreciated from reviewing FIGS. 8-10 and 20, the slide plate 80 and slide support 82 are generally oriented perpendicular (vertical) relative to the floor surface. In FIG. 10, it can be also seen how an optional plate 86 is secured to the slide support 82 for mounting foot pegs (not shown). A blade arm 88 extends from the slide plate 80 and cooperates with the blade assembly 46, described below.

One of the advantages of the blade adjustment arrangement 140 can be appreciated from review of FIG. 20. The slide plate 80 can be adjusted by the machine operator, while remaining in the seat 48 and without dismounting the machine 30. The bolts 144, 146 can be loosened while the operator remains seated in the seal 48 to vertically adjust the slide plate 80, and then the hydraulic cylinder 64 can be moved hydraulically, which will cause the slide plate 80 to move relative to the slide support 82. Once the slide plate 80 is in the desired position, the bolts 144, 146 can be tightened.

Another of the advantages of the blade adjustment arrangement 140 is the fact that only two bolts 144, 146 are needed to securely hold the slide plate 80 relative to the slide support 82. In a prior art design (e.g, see U.S. Pat. No. 7,562,412), a more complicated design was needed that required at least four bolts and two angle irons, and required operator dismount from the machine to adjust.

The floor stripping machine 30 includes a caster wheel 142. The caster wheel 142 is located generally forward of the seat 48 and under the base 32 generally under the gusset plate 84. When the hydraulic cylinder 64 is used to move the blade assembly 46 in a direction toward the floor surface, it will pivot the portion of the machine 30 upwardly so that the caster wheel 142 is off of the floor surface. This places even more force onto the blade assembly 46.

B. Example Blade Assemblies, FIGS. 10-27, 31 and 32

Turning now to the blade assembly 46, many embodiments can be made.

In this embodiment, the blade assembly 46 includes a removable clamp 74. The removable clamp has the cutter 72. The cutter 72 has a bottom 76 that is oriented to lie flat to the floor surface during operation of the machine 30 for some applications; in other applications, the bottom 76 is oriented at an angle of about 2-10° from the floor surface.

The blade assembly 46 includes a shank 78. The shank 78 is secured to the machine 30. In this example, the shank 78 is pivotably secured in a slot defined by the blade arm 88.

The hydraulic cylinder 64, mentioned above, extends at an angle from the gusset 84 positioned above the slide plate 80 and slide support 82. The hydraulic cylinder 64 is angled away from the slide plate 80 as it extends downward and away from the slide plate 80 to a position adjacent the shank 78. The blade arm 88 extends from the slide plate 80 and partially encloses sides of the shank 78. The hydraulic cylinder 64 is pivotably secured at pivots 90 (FIG. 2) and 91

(FIG. 3) extending from the blade arm 88. The shank 78 is between the pivots 90, 91 in the slot defined by the blade arm 88.

The shank 78 is designed to accommodate many different sizes of clamps 74. This has advantages in that, with some floor coverings, a narrower clamp 74 and cutter 72 may be desired, while in other types of floor coverings, a wider clamp 74 and cutter 72 will be better suited for the floor covering. One way of accomplishing this versatility is by including a dovetail 94 (FIGS. 14, 15, 23 and 24) on the shank 78. The dovetail 74 is at a remote end 96 (a clamp engaging end 108) of the shank 78. The clamp engaging end 108 is at an end of the shank 78 opposite from the end of the shank 78 that is secured to the machine 30.

The removable clamp 74 includes a shank engaging portion 98 and a clamp head 100 adjacent to the shank engaging portion 98. The shank engaging portion 98 defines a dovetail groove 102 that is sized to slidably mount on the dovetail 94 of the shank 78. A fastener 104, such as a bolt can be further used to removably secure the shank 78 and the clamp 74 together. In FIGS. 14, 15, 23, and 24 it can be seen how the fastener 104 is accommodated through a hole 106 in the clamp engaging end 108 of the shank 78. The clamp engaging end 108 defines the dovetail 94 along forward and rear surfaces 110, 111. The fastener 104 goes through the hole 106 and into a hole 114 located in the shank engaging portion 98 of the clamp 74.

Figure 25:
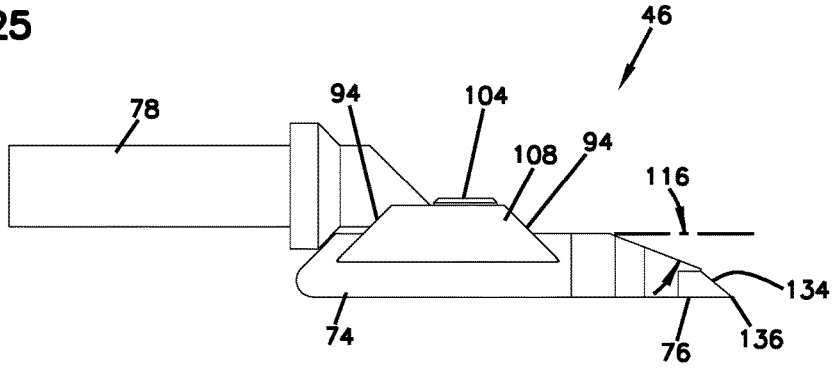
FIG. 25 is a side view of the blade assembly of FIG. 21.

The clamp head 100 is constructed and arranged to help cut, sheer, or skive floor covering, during use. In this embodiment, the clamp head 100 angles or slopes downwardly as the clamp head 100 extends in a direction from the shank engaging portion 98. The angle of the slope can vary, but advantages are achieved when the angle, shown at reference numeral 116 in FIG. 25 is between 10-30 degrees, for example, about 17-23 degrees. In some embodiments, the angle 116 is about 20 degrees.

Many different types of cutters 72 can be used. A few example embodiments of cutters are illustrated herein. FIGS. 11-18, 31, and 32 illustrate a first embodiment. In this embodiment, the cutter 72 includes a base flange 118 having a forward cutting edge 120. The base flange 118 further has a clamp engaging side 124 and a floor engaging side 126. The floor engaging side 126 is generally flat and planar such that, in some implementations, it can lie completely flat along the floor surface during operation of the machine 30.

In this embodiment, the base flange 118 defines a plurality of openings 122 extending therethrough. The blade assembly 46 includes a plurality of bolts 128, such as flathead screws, to extend from the floor engaging side 126, through the openings 122 and into openings 127 in the clamp 74 to removably secure the cutter 72 to the clamp 74. Alternative ways of connecting the blade assembly 46 to the clamp 74 are possible and this is merely one example.

Figure 18:
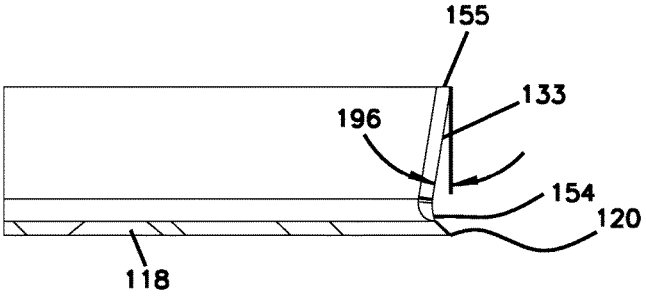
FIG. 18 is a cross-sectional view of the cutter of FIG. 16, the cross-section being taken along the line 18-18 of FIG. 17.
Figure 19:
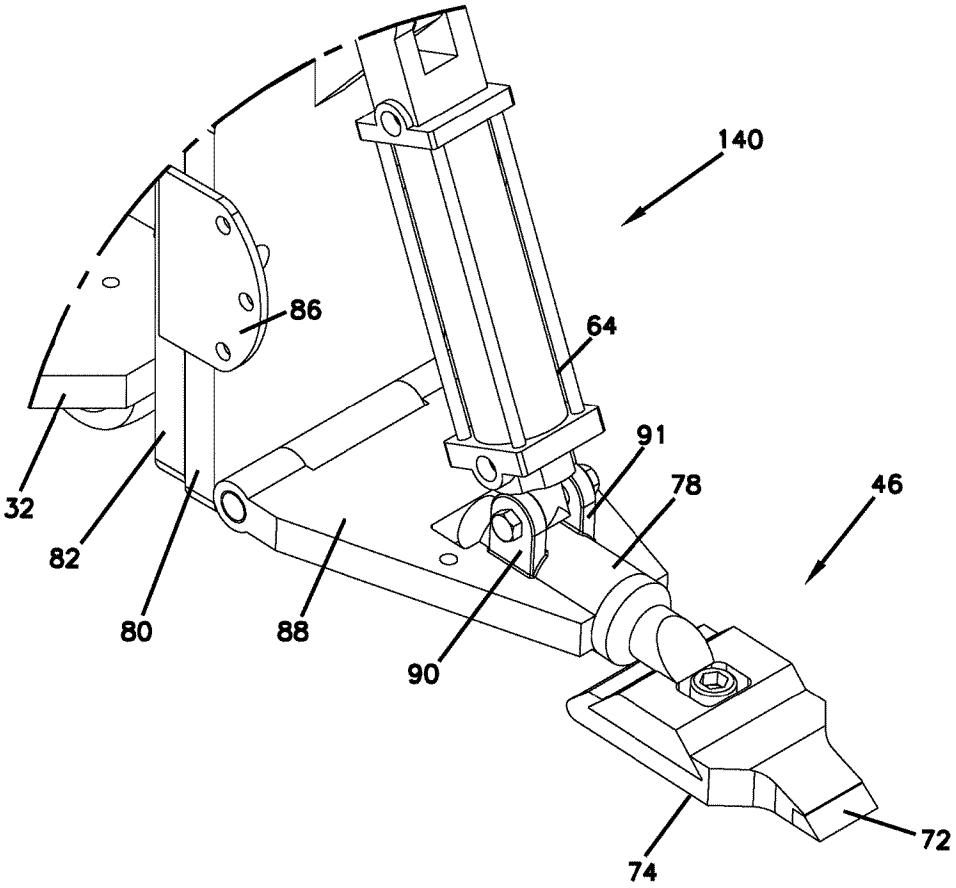
FIG. 19 is a perspective view of the portion A of FIG. 9.
Figure 32:
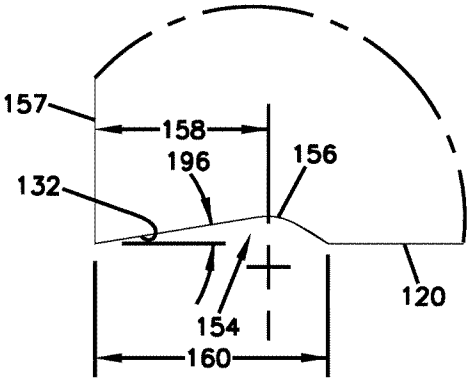
FIG. 32 is an enlarged view of Detail A of FIG. 31.

In this embodiment, the cutter 72 further includes a pair of side flanges 130, 131 extending from opposite ends of the base flange 118 and against sides of the clamp 74. The side flanges 130, 131 are angled relative to the base flange 118, generally perpendicular, but can be angled within a range of 70-110°. The side flanges 130, 131 can each include forward cutting edges 132, 133. As can be seen in FIGS. 18 and 32, the forward cutting edges 132, 133 angle outwardly at forward leading angle 196 (FIGS. 18 and 32) as they extend from the base flange 118 to the free end edges 155, 157 of the side flanges 130, 131. The angle 196 can be at least 1°, typically about 4-12°, and in example embodiments about 8-10°.

Figure 31:
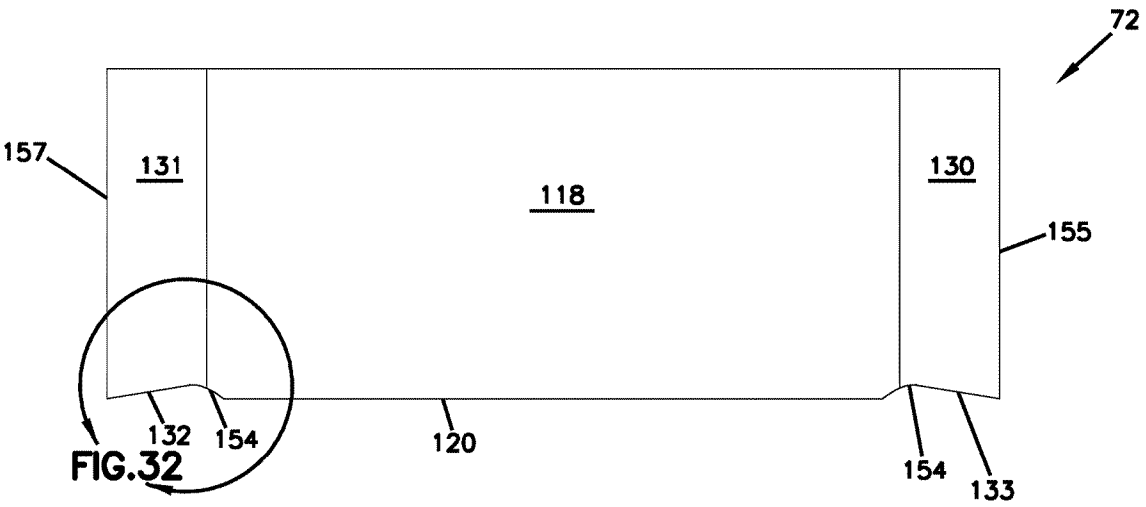
FIG. 31 is top view of the cutter of FIG. 16 but in a flattened version, before the sides are bent.

Advantages are achieved when the cutter 72 has a hooked section 154 (FIGS. 17, 18, 31, and 32) between the side flanges 130, 131 and the base flange 118. In FIG. 31, the cutter 72 is shown flat, prior to having the side flanges 130, 131 bent relative to the base flange 118. The hooked section 154 can be seen as a radius 156 (FIG. 32) between each cutting edge 132, 133 and the cutting edge 120 of the base flange 118. The radius 156 (FIG. 32) is about 0.2-0.3 inch, for example, about 0.22-0.24 inch. The hooked section 154 is spaced from each edge 155, 157 a distance at 158 (FIG. 32). The distance 158 is at least 0.7 inch, no greater than 1 inch, for example, about 0.75-0.85 inch. A distance 160 (FIG. 32) from a tip of the edges 155, 157 and where the front cutting edge 120 starts is at least 0.8 inch, no greater than 1.2 inches, for example about 1.0-1.1 inches.

The forward leaning angle 196 (FIGS. 18 and 32) relative to the cutting edge 120 cooperates with the hooked section 154 to result in advantages. For example, the forward leaning angle 196 along edges 132, 133 help to direct material being removed toward the hooked section 154, which is functioning as a scoring notch. This provides more surface area for cutting as compared to prior art right angle blades. Thus, the blade life is longer Another embodiment of the cutter 72 is illustrated in FIGS. 19-27. In this embodiment, the cutter 72 is non-removably secured to the clamp 74. For example, the cutter 72 can be welded or brazed onto the clamp head 100.

Figure 26:
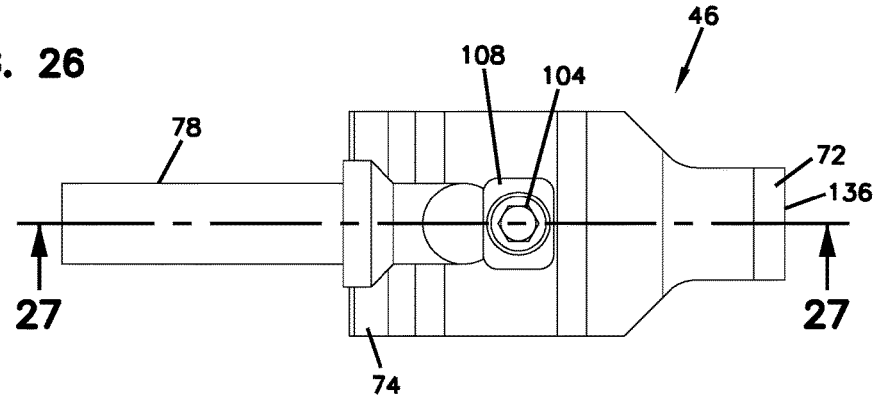
FIG. 26 is a top view of the blade assembly of FIG. 21.
Figure 27:
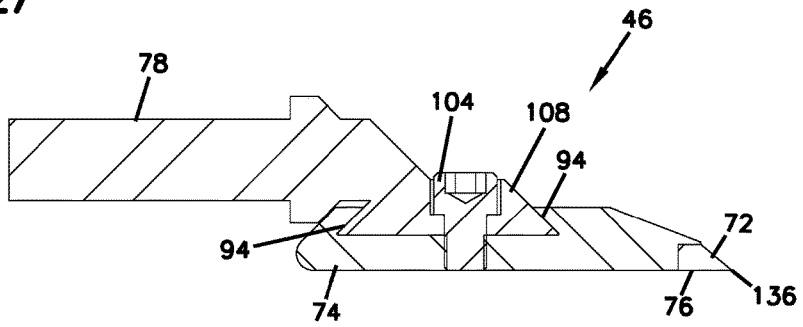
FIG. 27 is a cross-sectional view of the blade assembly of FIG. 21, the cross-section being taken along the line 27-27 of FIG. 26.

In FIGS. 25-27, the cutter 72 can be seen as having a sloped forward edge 134 that is on an opposite side as the bottom 76. The sloped forward edge 134 can be continuous along with the slope of the clamp head 100. The cutter 72 has at its remote end a cutting edge 136.

The cutter 72 of FIGS. 21-27 is narrower in width than a remaining portion of the clamp 74. This shape can help with wedging the cutter 72 under the floor covering.

For the embodiment of FIGS. 21-27, the cutter 72 can be made from a hard metal, such as carbide.

C. Design Advantages, FIG. 30

The machine 30 has advantages over the prior art. One advantage is due to a downward angle of the machine 30, from the rear wheel arrangement 38 toward the front of the machine 30. This is illustrated in FIG. 30.

Figure 30:
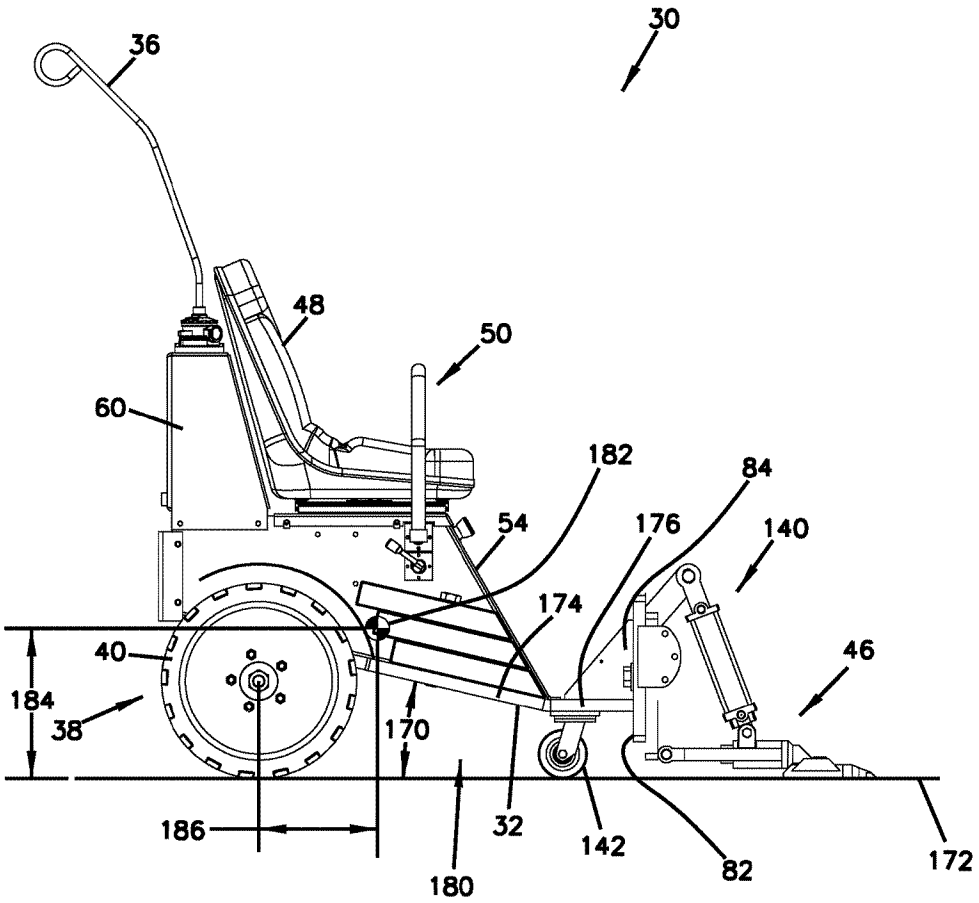
FIG. 30 is side view of the floor stripping machine, similar to the view of FIG. 2, and illustrating advantageous features, including a forward and downward angle to the machine, and a low center of gravity.

In FIG. 30, the base 32 slopes at a downward angle 170 measured between a ground plane or floor surface 172 and the base 32. The base 32 angles from just forward of the rear wheel arrangement 38 in a direction toward the blade assembly 46. In the example of FIG. 30, the base 32 has the sloped portion 174 and a second portion 176 that is generally parallel to the floor surface 172. The second portion 176 extends between a bottom of the front plate 54 and the blade adjustment arrangement 140; for example, the second portion 176 is between the front plate 54 and the slide support 82 of the blade adjustment arrangement 140. The second portion 176 has the caster wheel 142 extending from a bottom thereof to the floor surface 172.

The sloped portion 174 of the base 32 slopes at the downward angle 170 from the floor surface 172 at least 10°. In many embodiments, the angle 170 is no greater than 22°. In many preferred arrangements, the angle 170 is 12-15°, for example, about 13°.

The forward slope 174 helps to push the blade assembly 46 through the floor covering with the greatest degree of efficiency, allowing more work to be done with less weight. One result is that the machine 30 is smaller and lighter than prior art machines. The forward slope 174 allows the force generated by the rear wheel arrangement 38 to efficiently translate along a straight line directly to the blade assembly 46 and below the center of gravity 182. This allows the machine 30 to do the same work as a heavier and more powerful machine.

Machine 30 weighs no more than 900 pounds, without the extra weight stacks, and with the extra weight stacks, it weighs no more than 1000 pounds. This is at least 50% less than the weight of the majority of prior art machines doing comparable work. The machine 30 has small footprint, allowing it to be used almost anywhere and requiring lower horsepower. The machine 30 has a horsepower of at least 3.

The sloped portion 174 helps to create clearance under the machine 30 for debris. The clearance is shown by the open volume 180 between the sloped portion 174 and the floor surface 172. The base 32 is spaced from the floor surface 172 to provide the open volume 180 between the base and floor surface of no closer than 5 inches and typically, about 5-10 inches.

The machine 30 has a low center of gravity, especially compared to prior art machines doing similar work. The center of gravity is shown at 182. It is achieved through a combination of raising the rear portion of the machine 30; having the wheel motors 42, 43 (FIGS. 4 and 7) mounted under the base 32; and selecting the size of the tires for the wheels 40, 41 to be at least 16 inches.

The center of gravity 182 is spaced from the floor surface 172 no more than 40% of an overall height of the machine 30, when the maximum height is measured to a top of the hydraulic tank 60. In many instances, the center of gravity 182 is no more than 36% of the overall height of the machine 30. In this embodiment, the measurement 184 from the floor surface 172 to the center of gravity 182 is 12-13 inches, for example about 12.4-12.5 inches. A distance 186 of the center of gravity 182 from a hub of the wheel arrangement 38 to the center of gravity 182 is about 9-10 inches, for example, about 9.6-9.7 inches.

D. Example Methods

The floor stripping machine 30 can be used in a method of stripping a floor covering from a floor surface. The method includes driving the machine 30 having base 32, motor 34 secured to the base 32, seat 48 mounted to the base 32, and rear wheel arrangement 38 driven by the motor 34 to push the blade assembly 46 along a floor surface and sheer the floor covering from the floor surface. The base 32 will slope at a downward angle extending from forward of the rear wheel arrangement 38 in a direction toward the blade assembly 46, as measured from the floor surface.

Before the step of driving, there can be a step of mounting the machine 30 by sitting in the seat 48 without straddling obstructions; without moving a leg over any obstructions; and without having to use the machine 30 as a ladder to climb onto the machine 30.

The above represents example principles of this disclosure. Many embodiments can be made using these principles.

We claim:

1. A ride-on floor stripping machine for removing floor covering from a floor surface; the floor stripping machine comprising:

(a) a base;

(b) a motor secured to the base;

(c) a rear wheel arrangement driven by the motor;

(d) a seat for an operator mounted on the base;

(e) a blade assembly secured to a remaining portion of the machine;

(f) a caster wheel supporting the base and positioned between the rear wheel arrangement and the blade assembly; and (g) a blade adjustment arrangement secured to the base and holding the blade assembly in position; the blade adjustment arrangement including a vertically adjustable slide plate, whereby the slide plate is adjustable from the seat by the operator;

wherein the base slopes at a downward angle extending from forward of the rear wheel arrangement to the caster wheel, as measured from the floor surface.

2. The machine of claim 1 wherein the base slopes at the downward angle from the floor surface of at least 10°.

3. The machine of claim 2 wherein the base slopes at the downward angle from the floor surface of no greater than 22°.

4. The machine of claim 1 wherein the base slopes at the downward angle from the floor surface of 12-15°.

5. The machine of claim 1 wherein the base is spaced from the floor surface to provide an open volume between the base and floor surface of 5-10 inches.

6. The machine of claim 1 wherein the base is spaced from the floor surface no closer than 5 inches to provide an open volume between the base and floor surface.

7. The machine of claim 1 wherein an operator leg region is defined between a front edge of the seat and the blade adjustment arrangement, wherein the operator leg region is an obstruction-free open volume, whereby the operator can mount the machine and sit in the seat without having to straddle obstructions between legs and without having to move a leg over any obstructions and without having to use parts of the machine as a ladder to mount the machine.

8. The machine of claim 1 wherein the machine has a center of gravity that is spaced from the floor surface no more than 40% of an overall height of the machine.

9. A ride-on floor stripping machine for removing floor covering from a floor surface; the floor stripping machine comprising:

(a) a base;

(b) a motor secured to the base;

(c) a rear wheel arrangement driven by the motor;

(d) a seat for an operator mounted on the base;

(e) a blade assembly secured to a remaining portion of the machine; and (f) a blade adjustment arrangement secured to the base and holding the blade assembly in position; the blade adjustment arrangement including a vertically adjustable slide plate, whereby the slide plate is adjustable from the seat by the operator;

wherein the base slopes at a downward angle extending from forward of the rear wheel arrangement in a direction toward the blade assembly, as measured from the floor surface; the base being spaced from the floor surface no closer than 5 inches to provide an open volume between the base and floor surface.

10. The machine of claim 9 wherein the base slopes at the downward angle from the floor surface of at least 10°.

11. The machine of claim 10 wherein the base slopes at the downward angle from the floor surface of no greater than 22°.

12. The machine of claim 9 wherein the base slopes at the downward angle from the floor surface of 12-15°.

13. The machine of claim 9 wherein an operator leg region is defined between a front edge of the seat and the blade adjustment arrangement, wherein the operator leg region is an obstruction-free open volume, whereby the operator can mount the machine and sit in the seat without having to straddle obstructions between legs and without having to move a leg over any obstructions and without having to use parts of the machine as a ladder to mount the machine.

14. The machine of claim 9 wherein the machine has a center of gravity that is spaced from the floor surface no more than 40% of an overall height of the machine.

* * * * *